US010309356B2

(12) United States Patent
Oikawa et al.

(10) Patent No.: US 10,309,356 B2
(45) Date of Patent: Jun. 4, 2019

(54) FUEL INJECTION DEVICE

(71) Applicant: DENSO CORPORATION, Kariya, Aichi-pref. (JP)

(72) Inventors: Shinobu Oikawa, Kariya (JP); Tomoji Matsukawa, Kariya (JP); Shinsuke Yamamoto, Kariya (JP); Moriyasu Gotoh, Nishio (JP); Eiji Itoh, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/749,909

(22) PCT Filed: Jun. 21, 2016

(86) PCT No.: PCT/JP2016/002969
§ 371 (c)(1),
(2) Date: Feb. 2, 2018

(87) PCT Pub. No.: WO2017/022163
PCT Pub. Date: Feb. 9, 2017

(65) Prior Publication Data

US 2018/0245557 A1 Aug. 30, 2018

(30) Foreign Application Priority Data

Aug. 6, 2015 (JP) ..... 2015-156070

(51) Int. Cl.
*F02M 51/06* (2006.01)
*F02M 61/10* (2006.01)
*F02M 61/18* (2006.01)

(52) U.S. Cl.
CPC ..... *F02M 51/0675* (2013.01); *F02M 51/06* (2013.01); *F02M 51/061* (2013.01);
(Continued)

(58) Field of Classification Search
CPC .. F02M 51/06; F02M 51/061; F02M 51/0625; F02M 51/0653; F02M 51/0664;
(Continued)

(56) References Cited

U.S. PATENT DOCUMENTS 6,454,191 B1 9/2002 Spakowski et al.
2004/0085169 A1 5/2004 Matsusaka et al.
(Continued)

FOREIGN PATENT DOCUMENTS

EP 1 801 409 6/2007
EP 2 570 648 3/2013
(Continued)

*Primary Examiner* — Darren W Gorman
(74) *Attorney, Agent, or Firm* — Nixon & Vanderhye PC

(57) ABSTRACT

A gap forming member has: a plate portion that is placed on an opposite side of a needle, which is opposite from a valve seat; and an extending portion that is formed to extend from the plate portion toward the valve seat, while an opposite end part of the extending portion, which is opposite from the plate portion, is contactable with a movable core. A first wall surface of the gap forming member, which is a wall surface opposed to an outer wall of the flange, is slidable relative to the outer wall of the flange, and a second wall surface of the gap forming member, which is a wall surface opposed to an inner wall of a stationary core, forms a radial gap, which is a gap in a radial direction, between the second wall surface and the inner wall of the stationary core.

27 Claims, 9 Drawing Sheets

(52) U.S. Cl.
CPC .... *F02M 51/0653* (2013.01); *F02M 51/0671* (2013.01); *F02M 61/10* (2013.01); *F02M 61/18* (2013.01)

(58) Field of Classification Search
CPC ..... F02M 51/0671; F02M 51/0675; F02M 51/0682; F02M 51/0685; F02M 61/10; F02M 61/18; F02M 61/20; F02M 2200/304; F02M 2200/306; F02M 2200/50
See application file for complete search history.

(56) References Cited

U.S. PATENT DOCUMENTS

| | | | | |
|---|---|---|---|---|
| 2009/0200405 | A1* | 8/2009 | Yoshimaru ..... | F02M 51/0685 239/585.1 |
| 2011/0057059 | A1 | 3/2011 | Yamamoto et al. | |
| 2012/0080542 | A1 | 4/2012 | Imai et al. | |
| 2013/0075501 | A1* | 3/2013 | Miyake ..... | F02M 51/0671 239/585.3 |
| 2016/0097358 | A1 | 4/2016 | Miyake et al. | |
| 2018/0080420 | A1 | 3/2018 | Yamamoto et al. | |

FOREIGN PATENT DOCUMENTS

| | | | | |
|---|---|---|---|---|
| JP | 2000-170620 | | 6/2000 | |
| JP | 2008-82527 | | 4/2008 | |
| JP | 2012-52418 | | 3/2012 | |
| JP | 2014-141902 | | 8/2014 | |
| WO | WO-2014188765 | A1 * | 11/2014 | ..... F02M 51/0671 |
| WO | WO 2017/033370 | | 3/2017 | |
| WO | WO 2017/037973 | | 3/2017 | |

* cited by examiner

FUEL INJECTION DEVICE

CROSS REFERENCE TO RELATED APPLICATION

This application is the U.S. national phase of International Application No. PCT/JP2016/002969 filed on Jun. 21, 2016 and claims priority to Japanese Patent Application No. 2015-156070 filed on Aug. 6, 2015 the entire contents of each of which are hereby incorporated by reference.

TECHNICAL FIELD

The present disclosure relates to a fuel injection device that supplies fuel to an internal combustion engine.

BACKGROUND ART

Previously, there is known a fuel injection device that forms a gap in an axial direction between a movable core and a flange of a needle in such a manner that the movable core is accelerated in the gap and collides against the flange of the needle to implement valve opening of the needle. For example, the patent literature 1 discloses the fuel injection device that includes a gap forming member, which can form the gap in the axial direction between the movable core and the flange of the needle. In this fuel injection device, the movable core, which has an increased kinetic energy that is increased through the acceleration of the movable core in the gap, collides against the flange. Therefore, even though a fuel pressure in a fuel passage in an inside of a housing receiving the needle is high, the valve opening of the needle is possible. Thereby, the high pressure fuel can be injected.

In the fuel injection device of the patent literature 1, the gap forming member is shaped into a bottomed tubular form. An inner wall of a tubular portion of the gap forming member is slidable relative to an outer wall of the flange, and an outer wall of the tubular portion is slidable relative to an inner wall of the stationary core. In this way, reciprocation of the needle in an axial direction is guided. The needle is supported by the gap forming member and the stationary core only at one end part of the needle, which is opposite from a valve seat in the axial direction.

As discussed above, in the fuel injection device of the patent literature 1, the gap forming member has a double slide structure of that both of the inner wall and the outer wall of the tubular portion of the gap forming member are configured to slide along the other members. Therefore, a slide resistance, which is applied to the entire gap forming member, may possibly be increased, or wearing or uneven wearing of the slide surfaces may possibly occur upon a long time use. In this way, response of the needle may possibly be deteriorated, or reciprocation of the needle in the axial direction may possibly be unstabilized. Therefore, it may possibly cause variations in the injection amount of fuel injected from the fuel injection device. Furthermore, when the wear debris is generated, the wear debris may possibly be caught between corresponding members, which make relative movement therebetween, to possibly cause operational failure.

Furthermore, in the fuel injection device of the patent literature 1, the gap forming member has the double slide structure, so that the size management may become difficult, and the slide resistance may possibly vary from product-to-product. Thus, the injection amount of fuel may possibly vary among the fuel injection devices.

CITATION LIST

Patent Literature

PATENT LITERATURE 1: JP2014-227958A

SUMMARY OF INVENTION

The present disclosure is made in view of the above disadvantage, and it is an objective of the present disclosure to provide a fuel injection device that can inject high pressure fuel and can limit variations in an injection amount of fuel.

A first fuel injection device of the present disclosure includes a nozzle, a housing, a needle, a movable core, a stationary core, a gap forming member, a valve seat side urging member, a coil and a guide.

The nozzle includes an injection hole, through which fuel is injected, and a valve seat, which is formed around the injection hole and is shaped into a ring form.

The housing is shaped into a tubular form and has one end connected to the nozzle. The housing has a fuel passage, which is formed in an inside of the housing and is communicated with the injection hole.

The needle has: a needle main body, which is shaped into a rod form; a seal portion, which is formed at one end of the needle main body such that the seal portion is contactable with the valve seat; and a flange, which is formed on a radially outer side of the needle main body at another end of the needle main body or around the another end of the needle main body. The needle is installed such that the needle is reciprocatable in the fuel passage, and when the seal portion is lifted away from or is seated against the valve seat, the needle opens or closes the injection hole.

The movable core is installed such that the movable core is movable relative to the needle main body and has a surface, which is opposite from the valve seat and is contactable with a surface of the flange located on the valve seat side.

The stationary core is installed on an opposite side of the movable core, which is opposite from the valve seat, in the inside of the housing.

The gap forming member has: a plate portion that is placed on the opposite side of the needle, which is opposite from the valve seat, such that one end surface of the plate portion is contactable with the needle; and an extending portion that is formed to extend from the plate portion toward the valve seat, while an opposite end part of the extending portion, which is opposite from the plate portion, is contactable with the surface of the movable core located on the stationary core side. The gap forming member is configured to form an axial gap, which is a gap defined in an axial direction between the flange and the movable core, when the plate portion and the extending portion are in contact with the needle and the movable core, respectively.

The valve seat side urging member is placed on the opposite side of the gap forming member, which is opposite from the valve seat. The valve seat side urging member is operable to urge the needle and the movable core toward the valve seat.

The coil is operable to attract the movable core toward the stationary core such that the movable core contacts the flange and drives the needle toward the opposite side, which is opposite from the valve seat, when the coil is energized.

The guide is placed on the valve seat side of the movable core in the inside of the housing, and wherein an outer wall of the needle main body is slidable relative to the guide to guide reciprocation of the needle. With the above construction, the reciprocation of the needle in the axial direction is stabilized.

In the first fuel injection device of the present disclosure, as discussed above, the gap forming member is configured to form the axial gap between the flange and the movable core when the plate portion and the extending portion are in contact with the needle and the movable core, respectively. Therefore, at the time of magnetically attracting the movable core toward the stationary core through the energization of the coil, the movable core can collide against the flange after accelerating the movable core in the axial gap. In this way, the movable core, which has the increased kinetic energy through the acceleration of the movable core in the axial gap, can collide against the flange. Therefore, even when the fuel pressure in the fuel passage is high, the valve opening of the needle is possible. Thus, the high pressure fuel can be injected.

Furthermore, in the first fuel injection device of the present disclosure, the first wall surface of the gap forming member, which is the wall surface opposed to the outer wall of the flange, is slidable relative to the outer wall of the flange, and the second wall surface of the gap forming member, which is the wall surface opposed to the inner wall of the stationary core, forms the radial gap, which is the gap in the radial direction, between the second wall surface and the inner wall of the stationary core.

As discussed above, in the first fuel injection device of the present disclosure, among the first wall surface and the second wall surface of the gap forming member, only the first wall surface slides relative to the other member (the flange), and the second wall surface does not slide relative to the other member (the stationary core). Therefore, it is possible to reduce the slide resistance acting on the gap forming member, and thereby it is possible to limit wearing or uneven wearing of the slide surface upon aging. In this way, it is possible to limit deterioration of the response of the needle, and the axial reciprocation of the needle can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between the members, which make relative movement therebetween, and thereby it is possible to limit the malfunctioning.

Furthermore, in the first fuel injection device of the present disclosure, the gap forming member is constructed such that only the first wall surface slides relative to the flange. Therefore, management of the dimensions is eased, and it is possible to limit variations in the slide resistance among the individual products. Thus, it is possible to limit the variations in the injection amount of fuel even among the individual fuel injection devices.

In a second fuel injection device of the present disclosure, the gap forming member is formed such that a first wall surface of the gap forming member, which is opposed to an outer wall of the flange, forms a radial gap, which is defined in a radial direction, between the first wall surface and the outer wall of the flange, and a second wall surface of the gap forming member, which is a wall surface opposed to an inner wall of the stationary core, is slidable relative to the inner wall of the stationary core.

As discussed above, in the second fuel injection device of the present disclosure, among the first wall surface and the second wall surface of the gap forming member, only the second wall surface slides relative to the other member (the stationary core), and the first wall surface does not slide relative to the other member (the flange). Therefore, it is possible to reduce the slide resistance acting on the gap forming member, and thereby it is possible to limit wearing or uneven wearing of the slide surface upon aging. In this way, it is possible to limit deterioration of the response of the needle, and the axial reciprocation of the needle can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between the members, which make relative movement therebetween, and thereby it is possible to limit the malfunctioning.

Furthermore, in the second fuel injection device of the present disclosure, the gap forming member is constructed such that only the second wall surface slides relative to the stationary core. Therefore, management of the dimensions is eased, and it is possible to limit variations in the slide resistance among the individual products. Thus, it is possible to limit the variations in the injection amount of fuel even among the individual fuel injection devices.

A third fuel injection device of the present disclosure does not have the guide described above unlike the first and second fuel injection devices described above. The gap forming member is formed such that a first wall surface of the gap forming member, which is opposed to an outer wall of the flange, is slidable relative to the outer wall of the flange, and a second wall surface of the gap forming member, which is opposed to an inner wall of the stationary core, is slidable relative to the inner wall of the stationary core.

At least one of the first wall surface, the second wall surface, the outer wall of the flange and the inner wall of the stationary core is processed through a slide resistance reducing process, which reduces a slide resistance relative to another member, or a hardening process.

As discussed above, in the third fuel injection device of the present disclosure, although the gap forming member has a double slide structure that is constructed such that the first wall surface and the second wall surface respectively slide relative to the other members (the flange, the stationary core), the slide resistance reducing process or the hardening process is applied to the first wall surface, the second wall surface, the outer wall of the flange and the inner wall of the stationary core. Therefore, it is possible to reduce the slide resistance acting on the gap forming member, and thereby it is possible to limit wearing or uneven wearing of the slide surface upon aging. In this way, it is possible to limit deterioration of the response of the needle, and the axial reciprocation of the needle can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between the members, which make relative movement therebetween, and thereby it is possible to limit the malfunctioning.

DESCRIPTION OF EMBODIMENTS

Hereinafter, various embodiments of the present disclosure will be described with reference to the accompanying drawings. In the following embodiments, substantially identical structural portions will be indicated by the same reference signs and will not be redundantly described for the sake of simplicity.

First Embodiment

Figure 1:
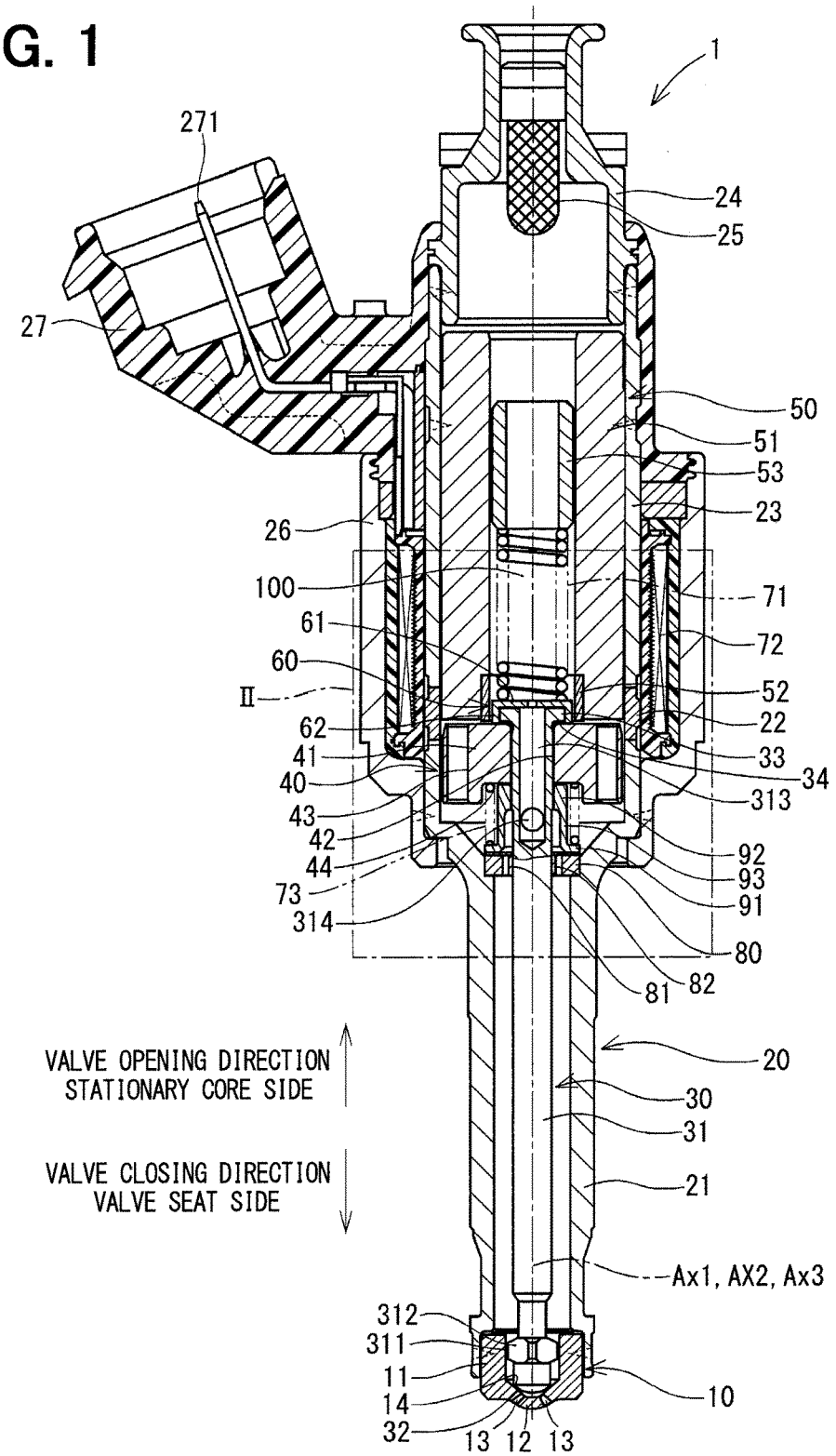
FIG. 1 is a cross-sectional view showing a fuel injection device according to a first embodiment of the present disclosure.

FIG. 1 shows a fuel injection valve according to a first embodiment of the present disclosure. A fuel injection device 1 is used in, for example, an undepicted direct injection type gasoline engine (serving as an internal combustion engine) and injects gasoline as fuel in the engine.

The fuel injection device 1 includes a nozzle 10, a housing 20, a needle 30, a movable core 40, a stationary core 50, a gap forming member 60, a spring 71 (serving as a valve seat side urging member), a coil 72, a guide 80, a spring seat 91, a limiting portion 92, and a spring 73 (serving as a stationary core side urging member).

The nozzle 10 is made of a material, such as martensitic stainless steel, which has a relatively high hardness. The nozzle 10 is quenched to have a predetermined hardness. The nozzle 10 includes a nozzle tubular portion 11 and a nozzle bottom portion 12 while the nozzle bottom portion 12 closes one end of the nozzle tubular portion 11. The nozzle bottom portion 12 includes a plurality of injection holes 13, each of which connects between an inner surface of the nozzle bottom portion 12, which is located on the nozzle tubular portion 11 side, and an opposite surface of the nozzle bottom portion 12, which is opposite from the nozzle tubular portion 11. The inner surface of the nozzle bottom portion 12, which is located on the nozzle tubular portion 11 side, has a valve seat 14, which is formed around the injection holes 13 and is shaped into a ring form.

The housing 20 includes a first tubular portion 21, a second tubular portion 22, a third tubular portion 23, an inlet portion 24 and a filter 25.

The first tubular portion 21, the second tubular portion 22 and the third tubular portion 23 are respectively shaped into a generally cylindrical tubular form. The first tubular portion 21, the second tubular portion 22 and the third tubular portion 23 are arranged one after another in this order to share a common axis (an axis Ax1) and are joined together.

The first tubular portion 21 and the third tubular portion 23 are made of a magnetic material, such as ferritic stainless steel, and are magnetically stabilized through a magnetic stabilization process. The first tubular portion 21 and the third tubular portion 23 have a relatively low hardness. In contrast, the second tubular portion 22 is made of a non-magnetic material, such as austenitic stainless steel. A hardness of the second tubular portion 22 is higher than the hardness of the first tubular portion 21 and the third tubular portion 23.

An end part of the nozzle tubular portion 11, which is opposite from the nozzle bottom portion 12, is joined to an inside of an end part of the first tubular portion 21, which is opposite from the second tubular portion 22. The first tubular portion 21 and the nozzle 10 are joined together by, for example, welding.

The inlet portion 24 is shaped into a tubular form and is made of metal, such as stainless steel. One end of the inlet portion 24 is joined to an inside of an end part of the third tubular portion 23, which is opposite from the second tubular portion 22. The inlet portion 24 and the third tubular portion 23 are joined together by, for example, welding.

A fuel passage 100 is formed in an inside of the housing 20 and the nozzle tubular portion 11. The fuel passage 100 is connected to the injection holes 13. A pipe (not shown) is connected to an opposite side of the inlet portion 24, which is opposite from the third tubular portion 23. In this way, the fuel, which is supplied from a fuel supply source, flows into the fuel passage 100 through the pipe. The fuel passage 100 guides the fuel to the injection holes 13.

The filter 25 is placed in an inside of the inlet portion 24. The filter 25 captures foreign objects contained in the fuel, which flows into the fuel passage 100.

The needle 30 is made of a material, such as martensitic stainless steel, which has a relatively high hardness. The needle 30 is quenched to have a predetermined hardness. The hardness of the needle 30 is set to be substantially the same as the hardness of the nozzle 10.

The needle 30 is received in the inside of the housing 20 in a manner that enables reciprocation of the needle 30 in the axial direction of the axis Ax1 of the housing 20 in the fuel passage 100. The needle 30 includes a needle main body 31, a seal portion 32 and a flange 33.

The needle main body 31 is shaped into a rod form, more specifically, an elongated cylindrical form. The seal portion 32 is formed at one end of the needle main body 31, that is, the seal portion 32 is formed at a valve seat 14 side end part of the needle main body 31. The seal portion 32 is contactable with the valve seat 14. The flange 33 is shaped into a ring form and is formed at the other end of the needle main body 31, that is, the flange 33 is formed at a radially outer side of an opposite end part of the needle main body 31, which is opposite from the valve seat 14. In the present embodiment, the flange 33 is formed integrally with the needle main body 31 in one piece.

A large diameter portion 311 is formed at a location that is around the one end of the needle main body 31. An outer diameter of one end side of the needle main body 31 is smaller than an outer diameter of the other end side of the needle main body 31. The outer diameter of the large diameter portion 311 is larger than the outer diameter of the one end side of the needle main body 31. The large diameter portion 311 is formed such that an outer wall of the large diameter portion 311 is slidable along an inner wall of the nozzle tubular portion 11 of the nozzle 10. In this way, reciprocation of the valve seat 14 side end part of the needle 30 in the axial direction of the axis Ax1 is guided. The large diameter portion 311 has chamfered portions 312 that are formed by chamfering a plurality of circumferential parts of the outer wall of the large diameter portion 311. Thereby, the fuel can flow through gaps, each of which is formed between a corresponding one of the chamfered portions 312 and the inner wall of the nozzle tubular portion 11.

An axial hole 313, which extends along an axis Ax2 of the needle main body 31, is formed at the other end of the needle main body 31. That is, the other end of the needle main body 31 is shaped into a hollow tubular form. Furthermore, the needle main body 31 has radial holes 314, each of which extends in a radial direction of the needle main body 31 such that the radial hole 314 communicates between a valve seat 14 side end part of the axial hole 313 and a space located at the outside of the needle main body 31. Thereby, the fuel in the fuel passage 100 can flow through the axial hole 313 and the radial holes 314. As discussed above, the needle main body 31 has the axial hole 313. The axial hole 313 extends in the axial direction of the axis Ax2 from an opposite end surface of the needle main body 31, which is opposite from the valve seat 14, and the axial hole 313 is communicated with the space outside of the needle main body 31 through the radial holes 314.

When the seal portion 32 of the needle 30 moves away (is lifted) from the valve seat 14 or contacts (is seated against) the valve seat 14, the needle 30 opens or closes the injection holes 13. Hereinafter, a direction of moving the needle 30 away from the valve seat 14 will be referred to as a valve opening direction, and a direction of contacting the needle 30 with the valve seat 14 will be referred to as a valve closing direction.

The movable core 40 includes a movable core main body 41. The movable core main body 41 is shaped into a generally cylindrical form and is made of a magnetic material, such as ferritic stainless steel. The movable core main body 41 is magnetically stabilized through a magnetic stabilization process. A hardness of the movable core main body 41 is relatively low and is substantially the same as the hardness of the first tubular portion 21 and the third tubular portion 23 of the housing 20.

The movable core 40 includes an axial hole 42, through-holes 43 and a recess 44. The axial hole 42 extends along an axis Ax3 of the movable core main body 41. In the present embodiment, an inner wall of the axial hole 42 is processed through a hardening process (e.g., Ni—P plating) and a slide resistance reducing process. The through-holes 43 are formed to connect between one end surface of the movable core main body 41, which is located on the valve seat 14 side, and an opposite end surface of the movable core main body 41, which is opposite from the valve seat 14. Each of the through-holes 43 has a cylindrical inner wall. In the present embodiment, the number of the through-holes 43 is four, and these through-holes 43 are arranged one after another at equal intervals in the circumferential direction of the movable core main body 41.

The recess 44 is formed at a center of the movable core main body 41 such that the recess 44 is circular and is recessed from the end surface of the movable core main body 41, which is located on the valve seat 14 side, toward the opposite side that is opposite from the valve seat 14. The axial hole 42 opens at a bottom of the recess 44.

The movable core 40 is received in the housing 20 in a state where the needle main body 31 of the needle 30 is inserted through the axial hole 42 of the movable core 40. An inner diameter of the axial hole 42 of the movable core 40 is set to be equal to or slightly larger than the outer diameter of the needle main body 31 of the needle 30. Therefore, the movable core 40 is movable relative to the needle 30 such that the inner wall of the axial hole 42 of the movable core 40 is slid along an outer wall of the needle main body 31 of the needle 30. Similar to the needle 30, the movable core 40 is received in the inside of the housing 20 in a manner that enables reciprocation of the movable core 40 in the axial direction Ax1 of the housing 20 in the fuel passage 100. The fuel in the fuel passage 100 can flow through the through-holes 43.

In the present embodiment, a surface of the movable core main body 41, which is opposite from the valve seat 14, is processed through a hardening process (e.g., hard chrome plating) and an anti-abrasion process.

An outer diameter of the movable core main body 41 is set to be smaller than an inner diameter of the first tubular portion 21 and an inner diameter of the second tubular portion 22. Therefore, when the movable core 40 is reciprocated in the fuel passage 100, an outer wall of the movable core 40 is not slid along an inner wall of the first tubular portion 21 and an inner wall of the second tubular portion 22.

A surface of the flange 33 of the needle 30, which is located on the valve seat 14 side, is contactable with the surface of the movable core main body 41, which is located on the side that is opposite from the valve seat 14. That is, the needle 30 has a contact surface 34 that is contactable with the surface of the movable core main body 41, which is located on the side that is opposite from the valve seat 14. The movable core 40 is formed such that the movable core 40 is movable relative to the needle 30 in such a manner that the movable core 40 is contactable with the contact surface 34 or is movable away from the contact surface 34.

The stationary core 50 is installed on the opposite side of the movable core 40, which is opposite from the valve seat 14, in the inside of the housing 20. The stationary core 50 includes a stationary core main body 51 and a bush 52. The stationary core main body 51 is shaped into a generally cylindrical tubular form and is made of a magnetic material, such as ferritic stainless steel. The stationary core main body 51 is magnetically stabilized through a magnetic stabilization process. A hardness of the stationary core main body 51 is relatively low and is substantially the same as the hardness of the movable core main body 41. The stationary core main body 51 is fixed to the inner side of the housing 20. The stationary core main body 51 and the third tubular portion 23 of the housing 20 are welded together.

The bush 52 is shaped into a generally cylindrical tubular form and is made of a material, such as martensitic stainless steel, which has a relatively high hardness. The bush 52 is installed to a recess 511 that is radially outwardly recessed from an inner wall of a valve seat 14 side end part of the stationary core main body 51. An inner diameter of the bush 52 is generally the same as an inner diameter of the stationary core main body 51. An end surface of the bush 52, which is located on the valve seat 14 side, is placed on the valve seat 14 side of an end surface of the stationary core main body 51, which is located on the valve seat 14 side. Therefore, the surface of the movable core main body 41, which is opposite from the valve seat 14, is contactable with the end surface of the bush 52, which is located on the valve seat 14 side.

The stationary core 50 is formed such that in the state where the seal portion 32 contacts the valve seat 14, the flange 33 of the needle 30 is placed in the inside of the bush 52. An adjusting pipe 53, which is shaped into a cylindrical tubular form, is press fitted to an inner side of the stationary core main body 51.

The gap forming member 60 is made of, for example, a non-magnetic material. A hardness of the gap forming member 60 is set to be generally the same as the hardness of the needle 30 and the hardness of the bush 52.

The gap forming member 60 is placed on the opposite side of the needle 30 and the movable core 40, which is opposite from the valve seat 14. The gap forming member 60 includes a plate portion 61 and an extending portion 62. The plate portion 61 is shaped into a generally circular plate form. The plate portion 61 is placed on the opposite side of the needle 30, which is opposite from the valve seat 14, such that one end surface of the plate portion 61 is contactable with the needle 30, more specifically, an end surface of the needle main body 31, which is opposite from the valve seat 14, and an end surface of the flange 33 of the needle 30, which is opposite from the valve seat 14.

The extending portion 62 is formed integrally with the plate portion 61 in one piece such that the extending portion 62 is shaped into a cylindrical tubular form and extends from an outer peripheral edge part of the one end surface of the plate portion 61 toward the valve seat 14. That is, in the present embodiment, the gap forming member 60 is shaped into a bottomed cylindrical tubular form. The gap forming member 60 is placed such that the flange 33 of the needle 30 is placed in the inside of the extending portion 62. Furthermore, an end part of the extending portion 62, which is opposite from the plate portion 61, is contactable with the end surface of the movable core main body 41, which is located on the stationary core 50 side.

In the present embodiment, the extending portion 62 is formed such that an axial length of the extending portion 62 is larger than an axial length of the flange 33. Therefore, the gap forming member 60 is configured such that in a state where the plate portion 61 contacts the needle 30, and the extending portion 62 contacts the movable core 40, an axial gap CL1, which is a gap in the axial direction of the axis Ax2, is formed between the flange 33 and the movable core 40.

An inner diameter of the extending portion 62 is set to be equal to or slightly larger than an outer diameter of the flange 33. Therefore, a first wall surface 601 of the gap forming member 60, which is a wall surface of an inner wall of the extending portion 62, i.e., a wall surface of the gap forming member 60 that is opposed to an outer wall of the flange 33, is slidable along the outer wall of the flange 33, and thereby the gap forming member 60 is movable relative to the needle 30.

Furthermore, an outer diameter of the plate portion 61 and the extending portion 62 is set to be smaller than the inner diameter of the stationary core 50. Therefore, a second wall surface 602 of the gap forming member 60, which is a wall surface of an outer wall of the plate portion 61 and the extending portion 62, i.e., a wall surface of the gap forming member 60 opposed to an inner wall of the bush 52 of the stationary core 50, forms a radial gap CL2, which is a gap in the radial direction, between the second wall surface 602 and the inner wall of the bush 52. Therefore, the second wall surface 602 of the gap forming member 60 does not slide along the inner wall of the bush 52.

In the present embodiment, since the extending portion 62 is shaped into the tubular form, an annular space S1 (a space shaped into an annular form) is formed by the contact surface 34 of the flange 33, the movable core 40 and the inner wall of the extending portion 62 in the state where the extending portion 62 and the movable core 40 contact with each other.

The gap forming member 60 further includes a hole 611. The hole 611 connects between one end surface of the plate portion 61 and the other end surface of the plate portion 61 and is communicatable with the axial hole 313 of the needle 30. Therefore, the fuel, which is located on the opposite side of the gap forming member 60 that is opposite from the valve seat 14 in the fuel passage 100, can flow to the valve seat 14 side of the movable core 40 through the hole 611, the axial hole 313 of the needle 30, and the radial holes 314 of the needle 30. An inner diameter of the hole 611 is smaller than the inner diameter of the bush 52 and an inner diameter of the axial hole 313. Therefore, when the needle 30 is moved together with the gap forming member 60 to the opposite side, which is opposite from the valve seat 14, i.e., when the needle 30 is moved in the valve opening direction, the fuel, which is located on the opposite side of the gap forming member 60 that is opposite from the valve seat 14, flows into the axial hole 313 after a flow of the fuel is restricted through the hole 611. In this way, it is possible to limit an excessive increase in the moving speed of the needle 30 in the valve opening direction.

The spring 71 is, for example, a coil spring and is placed on the opposite side of the gap forming member 60, which is opposite from the valve seat 14. One end of the spring 71 contacts the end surface of the plate portion 61 of the gap forming member 60, which is opposite from the extending portion 62. The other end of the spring 71 contacts the adjusting pipe 53. The spring 71 urges the gap forming member 60 toward the valve seat 14. In the state where the plate portion 61 of the gap forming member 60 contacts the needle 30, the spring 71 can urge the needle 30 toward the valve seat 14, i.e., in the valve closing direction through the gap forming member 60. Furthermore, in the state where the extending portion 62 of the gap forming member 60 contacts the movable core 40, the spring 71 can urge the movable core 40 toward the valve seat 14 through the gap forming member 60. That is, the spring 71 can urge the needle 30 and the movable core 40 toward the valve seat 14 through the gap forming member 60. An urging force of the spring 71 is adjusted by adjusting a location of the adjusting pipe 53 relative to the stationary core 50.

The coil 72 is shaped into a generally cylindrical tubular form and is arranged such that the coil 72 surrounds a radially outer side of the housing 20, particularly, a radially outer side of the second tubular portion 22 and the third tubular portion 23. When the coil 72 receives (energized with) an electric power, the coil 72 generates a magnetic force. When the coil 72 generates the magnetic force, the stationary core main body 51, the movable core main body 41, the first tubular portion 21 and the third tubular portion 23 form a magnetic circuit. In this way, a magnetic attractive force is generated between the stationary core main body 51 and the movable core main body 41, so that the movable core 40 is magnetically attracted to the stationary core 50 side. At this time, the movable core 40 is moved in the valve opening direction while the movable core 40 is accelerated in the axial gap CL1, and thereafter the movable core 40 collides against the contact surface 34 of the flange 33 of the needle 30. Therefore, the needle 30 is moved in the valve opening direction, so that the seal portion 32 is moved away from the valve seat 14, thereby resulting in the valve opening of the needle 30. As a result, the injection holes 13 are opened. As discussed above, by energizing the coil 72, the movable core 40 is magnetically attracted to the stationary core 50 side, and thereby the movable core 40 contacts the flange 33 and moves the needle 30 toward the opposite side that is opposite from the valve seat 14.

As discussed above, according to the present embodiment, in the valve closing state, the gap forming member 60 forms the axial gap CL1 between the flange 33 and the movable core 40. Therefore, at the time of energizing the coil 72, the movable core 40 can collide with the flange 33 after acceleration of the movable core 40 in the axial gap CL1. In this way, even in a case where the pressure in the fuel passage 100 is relatively high, the valve opening is possible without increasing the electric power supplied to the coil 72.

When the movable core 40 is magnetically attracted toward the stationary core 50 (in the valve opening direction) by the magnetic attractive force, the end surface of the movable core main body 41, which is located on the stationary core 50 side, collides with the end surface of the bush 52, which is located on the valve seat 14 side. In this way, the movement of the movable core 40 in the valve opening direction is limited.

As shown in FIG. 1, a radially outer side of the inlet portion 24 and a radially outer side of the third tubular portion 23 are molded with resin. A connector 27 is formed at this molded portion. Terminals 271, which supply the electric power to the coil 72, are insert-molded in the connector 27. A holder 26, which is shaped into a tubular form, is placed on a radially outer side of the coil 72 such that the holder 26 covers the coil 72.

The guide 80 is placed on the valve seat 14 side of the movable core 40 at the inside of the housing 20. The guide 80 is shaped generally into a circular plate form and is made of metal, such as stainless steel. The hardness of the guide 80 is set to be substantially the same as the hardness of the needle 30. The guide 80 includes a guide hole 81 and a plurality of flow passages 82. The guide hole 81 is formed to extend through a center of the guide 80 in a plate thickness direction. The guide 80 is arranged such that an outer peripheral edge portion of the guide 80 is fitted to the inner wall of the first tubular portion 21.

The needle 30 is arranged such that the needle 30 is inserted through the guide hole 81 of the guide 80. An inner diameter of the guide hole 81 is set to be equal to or slightly larger than an outer diameter of the needle main body 31 of the needle 30. Therefore, the guide 80 can guide the reciprocation of the needle 30 in the axial direction such that an inner wall of the guide hole 81 slides along the outer wall of the needle main body 31.

In the present embodiment, the valve seat 14 side end part of the needle 30 is reciprocatably supported by the inner wall of the nozzle tubular portion 11 of the nozzle 10, and a stationary core 50 side part of the needle 30 is reciprocatably supported by the guide 80. As discussed above, the reciprocation of the needle 30 in the axial direction is guided at the two locations that are placed one after another in the axial direction of the axis Ax1 of the housing 20.

The flow passages 82 are arranged on the radially outer side of the guide hole 81 such that the flow passages 82 penetrate through the guide 80 in a plate thickness direction of the guide 80. The number of the flow passages 82 is, for example, four, and these flow passages 82 are arranged one after another at equal intervals in the circumferential direction of the guide 80. The fuel in one space of the fuel passage 100, which is located on the stationary core 50 side of the guide 80, can flow into another space of the fuel passage 100, which is located on the valve seat 14 side of the guide 80, through the flow passages 82. In the present embodiment, the radial holes 314 are formed such that the radial holes 314 are positioned on the stationary core 50 side of the guide 80 in the state where the seal portion 32 of the needle 30 contacts the valve seat 14.

In the present embodiment, the spring seat 91 and the limiting portion 92 are joined together through a tubular portion 93. The spring seat 91, the limiting portion 92 and the tubular portion 93 are made of metal, such as stainless steel and are formed integrally in one piece.

The spring seat 91 is shaped into a ring form and is placed on the radially outer side of the needle main body 31 at a location between the movable core 40 and the guide 80.

The limiting portion 92 is formed into a tubular form and is placed on the radially outer side of the needle main body 31 at a location that is between the movable core 40 and the spring seat 91. The inner wall of the limiting portion 92 is fitted to the outer wall of the needle main body 31, and thereby the limiting portion 92 is fixed to the needle main body 31.

The tubular portion 93 is shaped into a tubular form while one end of the tubular portion 93 is connected to the spring seat 91, and the other end of the tubular portion 93 is connected to the limiting portion 92. In this way, the spring seat 91 is fixed to the radially outer side of the needle main body 31 at the location, which is between the movable core 40 and the guide 80.

The spring 73 is, for example, a coil spring and is placed such that one end of the spring 73 contacts the spring seat 91, and the other end of the spring 73 contacts the bottom of the recess 44 of the movable core 40. The spring 73 can urge the movable core 40 toward the stationary core 50. An urging force of the spring 73 is smaller than the urging force of the spring 71.

The spring 71 urges the gap forming member 60 toward the valve seat 14, so that the plate portion 61 of the gap forming member 60 contacts the needle 30, and thereby the seal portion 32 of the needle 30 is urged against the valve seat 14. At this time, the spring 73 urges the movable core 40 toward the stationary core 50, so that the extending portion 62 of the gap forming member 60 contacts the movable core 40. In this state, the axial gap CL1 is formed between the contact surface 34 of the flange 33 of the needle 30 and the movable core 40, and a gap CL3 is formed between the bottom of the recess 44 of the movable core 40 and the limiting portion 92 (see FIG. 2).

The movable core 40 is reciprocatable in the axial direction between the flange 33 of the needle 30 and the limiting portion 92. The bottom of the recess 44 of the movable core 40 is contactable with a movable core 40 side end part of the limiting portion 92. The limiting portion 92 is configured to limit the relative movement of the movable core 40 relative to the needle 30 toward the valve seat 14 through contact of the limiting portion 92 with the movable core 40.

Furthermore, in the present embodiment, a cylindrical space S2, which is a space in a cylindrical form, is formed between the tubular portion 93 and the spring seat 91, which are located on one side of the cylindrical space S2, and the needle main body 31, which is located on the other side of the cylindrical space S2. The radial holes 314 of the needle 30 are communicated with the cylindrical space S2. Thereby, the fuel in the axial hole 313 can flow toward the valve seat 14 side of the guide 80 through the radial holes 314, the cylindrical space S2 and the flow passages 82.

In the present embodiment, in the state where the movable core 40 is magnetically attracted toward the stationary core 50, when the energization of the coil 72 is stopped, the needle 30 and the movable core 40 are urged toward the valve seat 14 by the urging force of the spring 71 conducted through the gap forming member 60. In this way, the needle 30 moves in the valve closing direction, so that the seal portion 32 contacts the valve seat 14, thereby resulting in the valve closing of the needle 30. Thus, the injection holes 13 are closed.

After the contacting of the seal portion 32 with the valve seat 14, the movable core 40 is moved relative to the needle 30 toward the valve seat 14 by inertia. At this time, the limiting portion 92 can limit excess movement of the movable core 40 toward the valve seat 14 through contact of the limiting portion 92 with the movable core 40. In this way, the deterioration of the response at the next valve opening time can be limited. Furthermore, the shock at the time of contacting of the movable core 40 to the limiting portion 92 can be reduced by the urging force of the spring 73, and thereby it is possible to limit the secondary valve opening, which is caused by bouncing of the needle 30 at the valve seat 14. Furthermore, the movement of the movable core 40 toward the valve seat 14 is limited by the limiting portion 92, so that it is possible to limit excessive compression of the spring 73. Thus, it is possible to limit the secondary valve opening that is caused by recollision of the movable core 40 against the flange 33 due to urging of the movable core 40 in the valve opening direction by a restoring force of the spring 73, which has been excessively compressed.

Furthermore, according to the present embodiment, in the state where the seal portion 32 of the needle 30 contacts the valve seat 14, a gap CL4, which is in a ring form, is formed between the spring seat 91 and the guide 80. Therefore, when the needle 30 is moved in the valve closing direction, a damper effect is generated at the gap CL4, and thereby the moving speed of the needle 30 in the valve closing direction can be reduced. In this way, the shock, which would be generated at the time of contacting of the seal portion 32 of the needle 30 to the valve seat 14, can be reduced, and thereby it is possible to limit the secondary valve opening, which is caused by bouncing of the needle 30 at the valve seat 14.

In the present embodiment, the gap forming member 60 further includes a passage 621. The passage 621 is formed in a form of a groove that is recessed from a movable core 40 side end part of the extending portion 62 toward the plate portion 61. The passage 621 connects between the inner wall and the outer wall of the extending portion 62. In this way, at the time of contacting the extending portion 62 with the movable core 40, the fuel in the annular space S1 can flow to the outside of the extending portion 62 through the passage 621. Furthermore, the fuel at the outside of the extending portion 62 can flow into the inside of the extending portion 62, i.e., the annular space S1 through the passage 621. Thus, at the time of contacting the extending portion 62 with the movable core 40, it is possible to limit the damper effect that is generated due to the presence of the fuel in the annular space S1. Therefore, it is possible to limit a reduction of a kinetic energy of the movable core 40 at the time of colliding the movable core 40 against the contact surface 34 of the flange 33.

The fuel, which is supplied from the inlet portion 24, flows through the stationary core 50, the adjusting pipe 53, the hole 611 of the gap forming member 60, the axial hole 313 of the needle 30, the radial holes 314, the cylindrical space S2, the flow passages 82, the gap between the first tubular portion 21 and the needle 30, and the gap between the nozzle 10 and the needle 30, i.e., the fuel passage 100 and is guided to the injection holes 13. At the time of operating the fuel injection device 1, an area around the movable core 40 is filled with the fuel. Furthermore, at the time of operating the fuel injection device 1, the fuel flows through the through-hole 43 of the movable core 40. Therefore, the movable core 40 can smoothly reciprocate in the axial direction at the inside of the housing 20.

Next, the operation of the fuel injection device 1 of the present embodiment will be described with reference to FIGS. 2 to 5.

Figure 2:
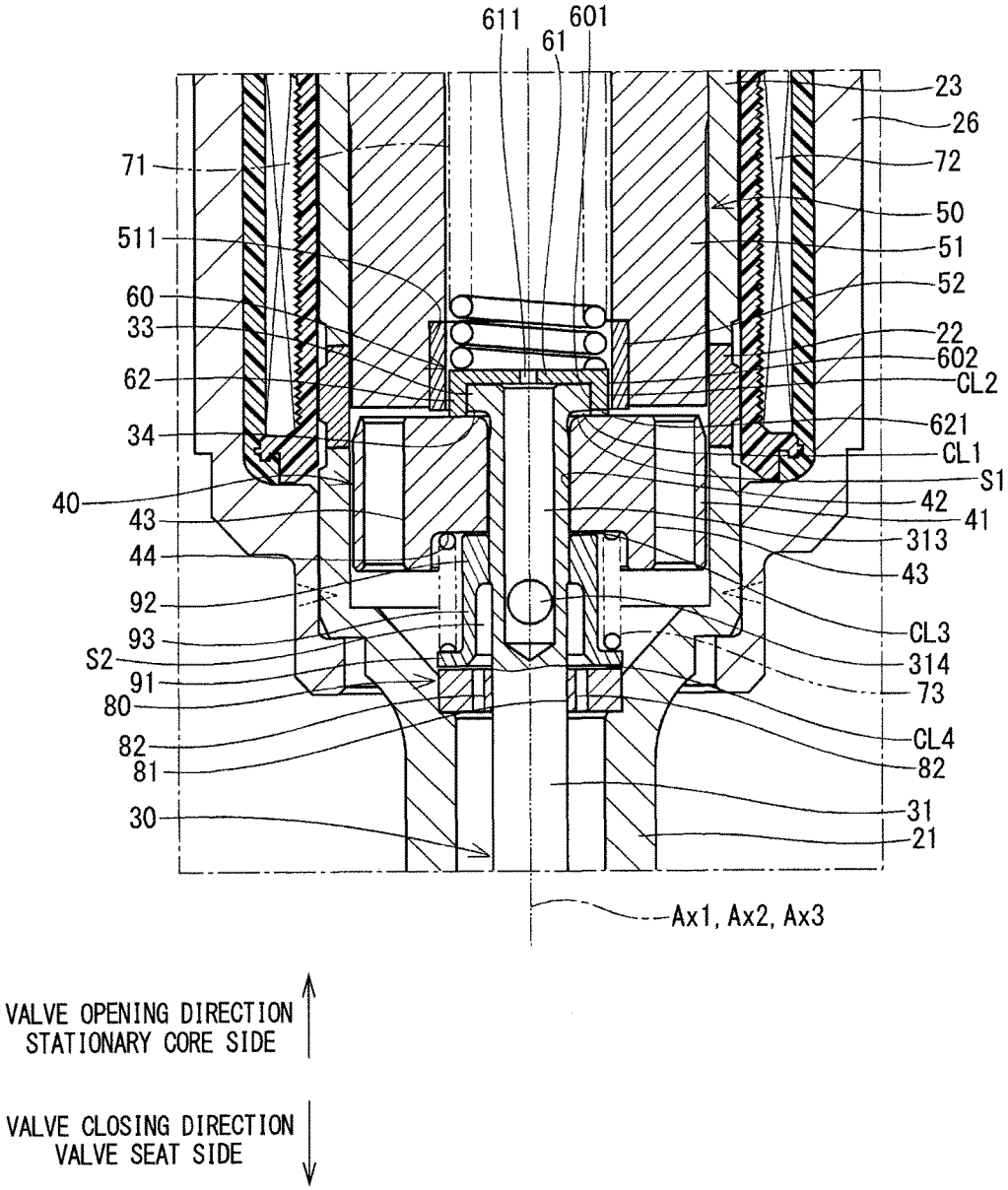
FIG. 2 is an enlarged view of a portion II in FIG. 1.

As shown in FIG. 2, when the coil 72 is not energized, the seal portion 32 of the needle 30 contacts the valve seat 14, while the plate portion 61 of the gap forming member 60 contacts the needle 30, and the extending portion 62 of the gap forming member 60 contacts the movable core 40. At this time, the axial gap CL1 is formed between the contact surface 34 of the flange 33 and the movable core 40.

When the coil 72 is energized in the state shown in FIG. 2, the movable core 40 is magnetically attracted to the stationary core 50 and is thereby moved toward the stationary core 50 while the movable core 40 upwardly pushes the gap forming member 60 and is accelerated in the axial gap CL1. The movable core 40, which is accelerated in the axial gap CL1 and is thereby in the increased kinetic energy state, collides against the contact surface 34 of the flange 33 (see FIG. 3). In this way, the seal portion 32 moves away from the valve seat 14, thereby resulting in the valve opening of the needle 30. Thereby, the injection of the fuel from the injection holes 13 begins. At this time, the axial gap CL1 becomes zero. Furthermore, the size of the gap CL3 is increased in comparison to the state shown in FIG. 2.

Figure 3:
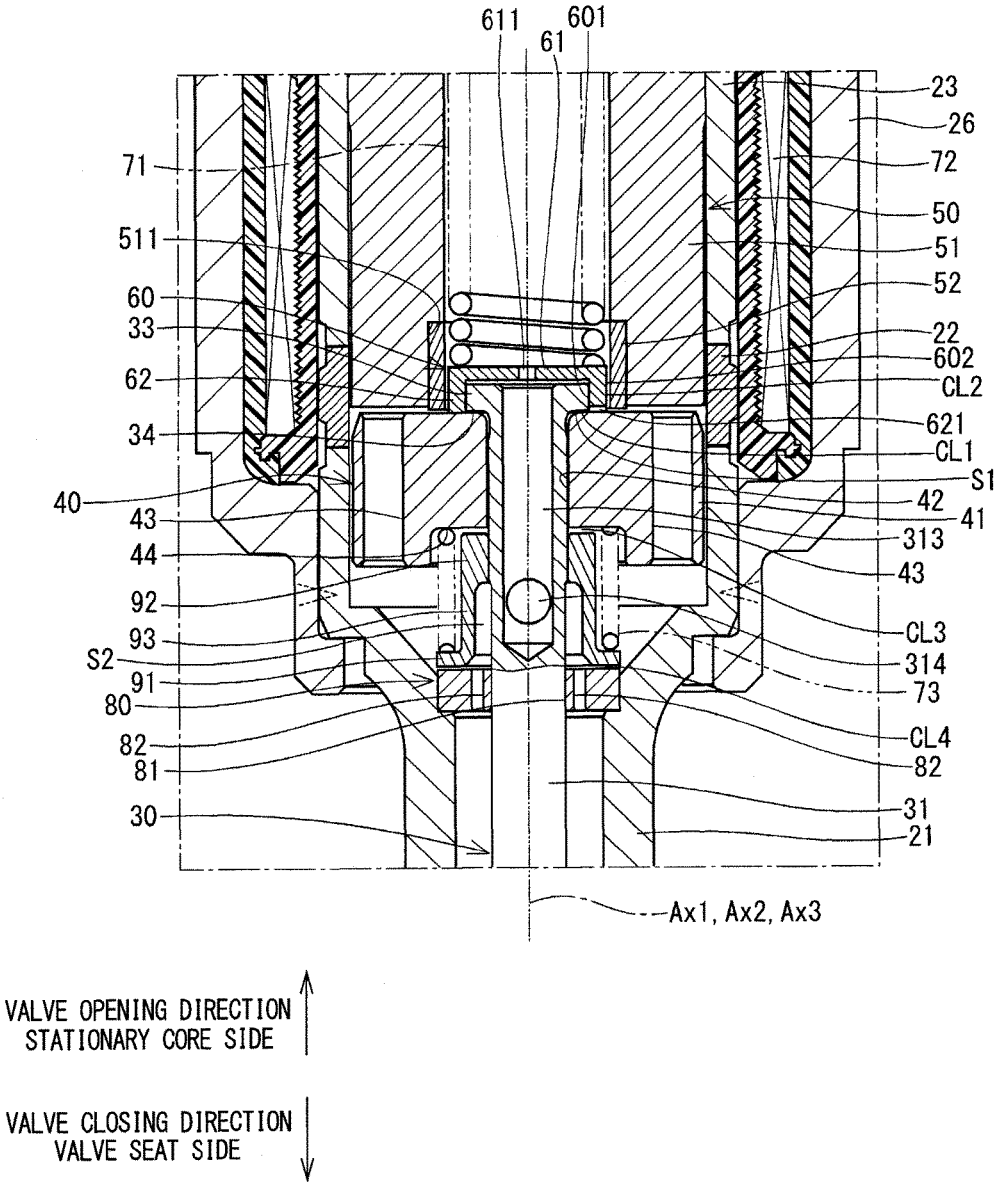
FIG. 3 is a cross-sectional view showing a movable core and its adjacent area at the fuel injection device according to the first embodiment of the present disclosure at a time of contacting the movable core to a flange during a valve opening time.

When the movable core 40 is further moved toward the stationary core 50 from the state shown in FIG. 3, the movable core 40 contacts the bush 52. Thereby, the movement of the movable core 40 in the valve opening direction is limited. At this time, the needle 30 is further moved in the valve opening direction by the inertia and contacts the plate portion 61 of the gap forming member 60 (see FIG. 4). At this time, the size of the gap CL4 is increased in comparison to the state shown in FIG. 3.

Figure 4:
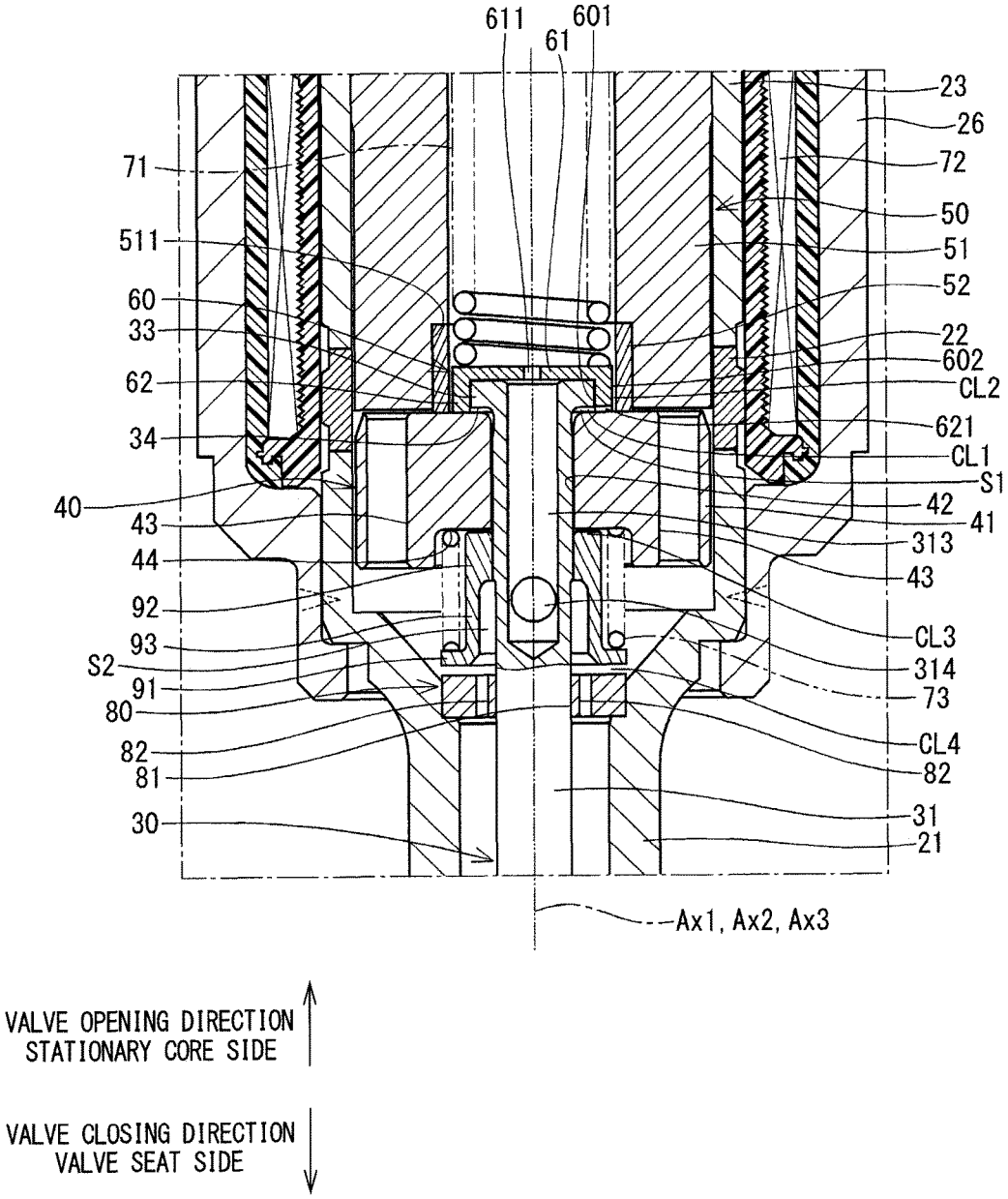
FIG. 4 is a cross-sectional view showing the movable core and its adjacent area at the fuel injection device according to the first embodiment of the present disclosure at a time of contacting the movable core to a stationary core during the valve opening time.
Figure 5:
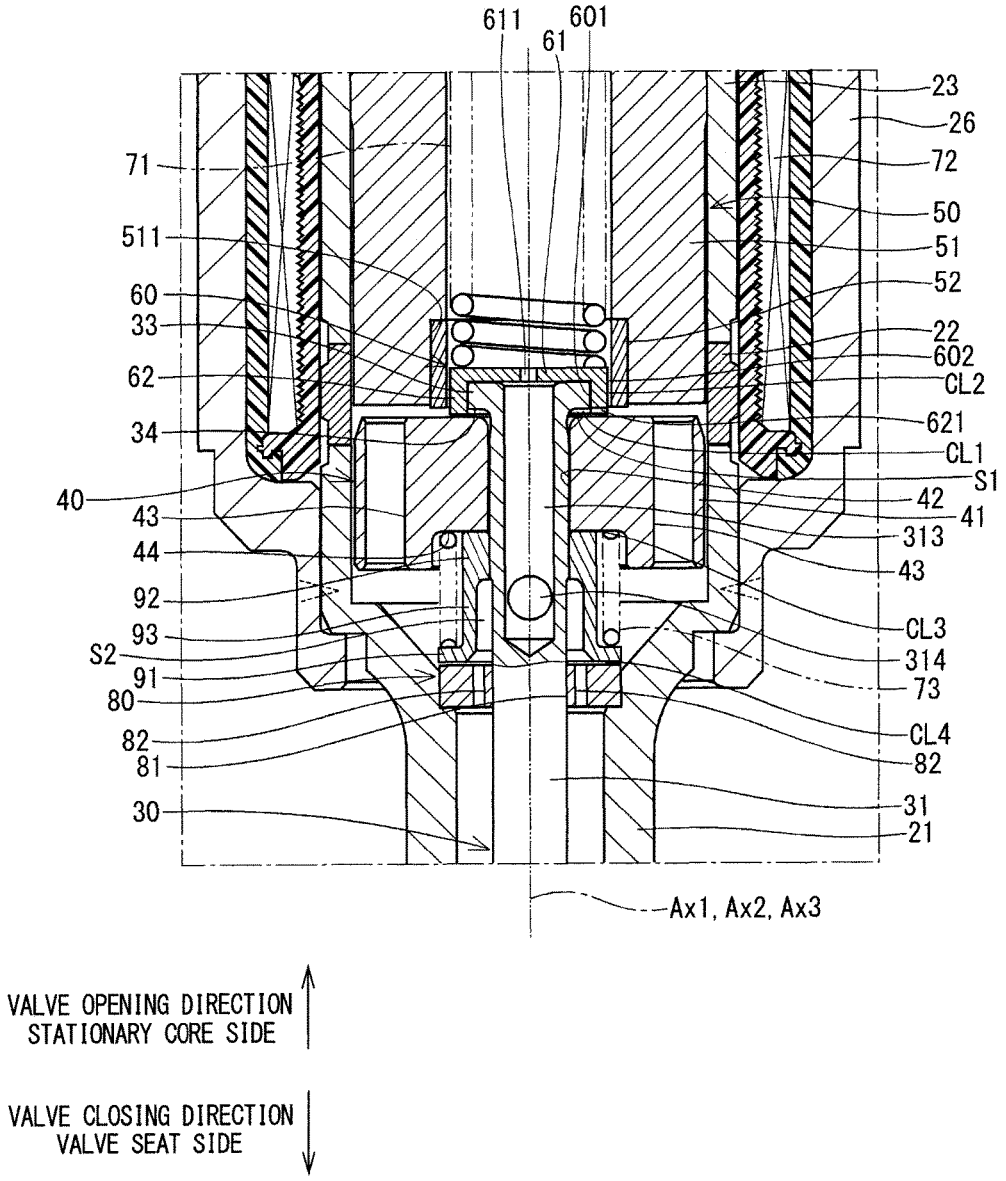
FIG. 5 is a cross-sectional view showing the movable core and its adjacent area at the fuel injection device according to the first embodiment of the present disclosure at a time of contacting the movable core to a limiting portion during a valve closing time.

In a state shown in FIG. 4, when the energization of the coil 72 is stopped, the movable core 40 and the needle 30 are moved in the valve closing direction by the urging force of the spring 71 conducted through the gap forming member 60. When the seal portion 32 of the needle 30 contacts the valve seat 14 to result in the valve closing of the needle 30, the movable core 40 is further moved in the valve closing direction by the inertia and contacts the limiting portion 92 (see FIG. 5). Thereby, the movement of the movable core 40 in the valve closing direction is limited. At this time, the movable core 40 is spaced from the extending portion 62 of the gap forming member 60. Furthermore, the gap CL3 becomes zero. Thereafter, the movable core 40 is moved in the valve opening direction by the urging force of the spring 73 and contacts the extending portion 62 of the gap forming member 60 (see FIG. 2).

As discussed above, (1) according to the present embodiment, the nozzle 10 includes the injection holes 13, through which the fuel is injected, and the valve seat 14, which is formed around the injection holes 13 and is shaped into the ring form.

The housing 20 is shaped into the tubular form and has the one end connected to the nozzle 10, and the housing 20 has the fuel passage 100, which is formed in the inside of the housing 20 and is communicated with the injection holes 13.

The needle 30 has: the needle main body 31, which is shaped into the rod form; the seal portion 32, which is formed at one end of the needle main body 31 such that the seal portion 32 is contactable with the valve seat 14; and the flange 33, which is formed on the radially outer side of the other end of the needle main body 31. The needle 30 is installed such that the needle 30 is reciprocatable in the fuel passage 100. When the seal portion 32 moves away from or contacts the valve seat 14, the needle 30 opens or closes the injection holes 13.

The movable core 40 is installed such that the movable core 40 is movable relative to the needle main body 31 and has the surface, which is opposite from the valve seat 14 and is contactable with the surface (the contact surface 34) of the flange 33 located on the valve seat 14 side.

The stationary core 50 is installed on the opposite side of the movable core 40, which is opposite from the valve seat 14, in the inside of the housing 20.

The gap forming member 60 includes: the plate portion 61 that is placed on the opposite side of the needle 30, which is opposite from the valve seat 14, such that the one end surface of the plate portion 61 is contactable with the needle 30; and the extending portion 62 that is formed to extend from the plate portion 61 toward the valve seat 14, while the opposite end part of the extending portion 62, which is opposite from the plate portion 61, is contactable with the surface of the movable core 40 located on the stationary core 50 side. The gap forming member 60 is configured to form the axial gap CL1, which is a gap defined in the axial direction between the flange 33 and the movable core 40, when the plate portion 61 and the extending portion 62 contact the needle 30 and the movable core 40, respectively.

The spring 71 is placed on the side of the gap forming member 60, which is opposite from the valve seat 14. The spring 71 can urge the needle 30 and the movable core 40 toward the valve seat 14 through the gap forming member 60.

The coil 72 is operable to attract the movable core 40 toward the stationary core 50 such that the movable core 40 contacts the flange 33 and drives the needle 30 toward the opposite side, which is opposite from the valve seat 14, when the coil 72 is energized.

The guide 80 is placed on the valve seat 14 side of the movable core 40 in the inside of the housing 20. An outer wall of the needle main body is slidable relative to the guide 80 to guide reciprocation of the needle 30. With the above construction, the reciprocation of the needle 30 in the axial direction is stabilized.

In the present embodiment, as discussed above, the gap forming member 60 is configured to form the axial gap CL1 between the flange 33 and the movable core 40 when the plate portion 61 and the extending portion 62 contact the needle 30 and the movable core 40, respectively. Therefore, at the time of magnetically attracting the movable core 40 toward the stationary core 50 through the energization of the coil 72, the movable core 40 can collide against the flange 33 after accelerating the movable core 40 in the axial gap CL1. In this way, the movable core 40, which has the increased kinetic energy through the acceleration of the movable core 40 in the axial gap CL1, can collide against the flange 33. Therefore, even when the fuel pressure in the fuel passage 100 is high, the valve opening of the needle 30 is possible. Thus, the high pressure fuel can be injected.

Furthermore, in the present embodiment, the first wall surface 601 of the gap forming member 60, which is the wall surface opposed to the outer wall of the flange 33, is slidable relative to the outer wall of the flange 33, and the second wall surface 602 of the gap forming member 60, which is the wall surface opposed to the inner wall of the stationary core 50, forms the radial gap CL2, which is the gap in the radial direction, between the second wall surface 602 and the inner wall of the stationary core 50.

As discussed above, in the present embodiment, among the first wall surface 601 and the second wall surface 602 of the gap forming member 60, only the first wall surface 601 slides relative to the other member (the flange 33), and the second wall surface 602 does not slide relative to the other member (the stationary core 50). Therefore, it is possible to reduce the slide resistance acting on the gap forming member 60, and thereby it is possible to limit wearing or uneven wearing of the slide surface upon aging. In this way, it is possible to limit deterioration of the response of the needle 30, and the axial reciprocation of the needle 30 can be stabilized for a long time. Thus, it is possible to limit variations in the injection amount of fuel, which is injected from the fuel injection device 1. Furthermore, it is possible to limit generation of wear debris. Thus, it is possible to limit clamping of the wear debris between the members, which make relative movement therebetween, and thereby it is possible to limit malfunctioning.

Furthermore, according to the present embodiment, the gap forming member 60 is constructed such that only the first wall surface 601 slides relative to the flange 33. Therefore, management of the dimensions is eased, and it is possible to limit variations in the slide resistance among the individual products. Thus, it is possible to limit the variations in the injection amount of fuel even among the individual fuel injection devices 1.

In the present embodiment, the gap forming member 60 is constructed such that the first wall surface 601 slides relative to the outer wall of the flange 33. Therefore, the radial movement of the gap forming member 60 relative to the needle 30 is limited. Therefore, it is possible to limit the sliding of the second wall surface 602 of the gap forming member 60 relative to the inner wall of the bush 52.

Furthermore, (3) in the present embodiment, the guide 80 is formed separately from the housing 20. Therefore, in comparison to the case where the guide 80 is formed integrally with the housing 20 in one piece, the guide 80 can be easily formed.

Furthermore, (4) in the present embodiment, the spring seat 91 and the spring 73 are provided.

The spring seat 91 is shaped into a ring form and is fixed to the radially outer side of the needle main body 31 at the location between the movable core 40 and the guide 80.

The spring 73 is placed between the movable core 40 and the spring seat 91 and has the urging force, which is smaller than the urging force of the spring 71. The spring 73 is operable to urge the movable core 40 toward the stationary core 50.

Thereby, the movable core 40 is urged against the extending portion 62 of the gap forming member 60, so that the size of the axial gap CL1, which is measured when the plate portion 61 and the needle 30 contact with each other, can be stabilized.

Furthermore, the spring seat 91, which is shaped into the ring form, is placed between the movable core 40 and the guide 80 and forms the gap CL4 between the spring seat 91 and the guide 80. Therefore, when the needle 30 is moved in the valve closing direction, the damper effect is generated at the gap CL4, and thereby the moving speed of the needle 30 in the valve closing direction can be reduced. In this way, the shock, which would be generated at the time of contacting of the seal portion 32 of the needle 30 to the valve seat 14, can be reduced, and thereby it is possible to limit the secondary valve opening, which is caused by bouncing of the needle 30 at the valve seat 14.

Furthermore, in the present embodiment, the guide 80 is formed separately from the housing 20, so that various types of guides 80, which respectively vary from one another with respect to the shape of the spring seat 91 side surface, can be used to vary various factors, such as the degree of the damper effect at the gap CL4.

Furthermore, (5) according to the present embodiment, the limiting portion 92 is provided.

The limiting portion 92 is fixed to the radially outer side of the needle main body 31 at the location between the movable core 40 and the guide 80, so that the limiting portion 92 can contact the valve seat 14 side surface of the movable core 40 to limit movement of the movable core 40 toward the valve seat 14. Therefore, it is possible to limit the excess movement of the movable core 40 toward the valve seat 14. In this way, the deterioration of the response at the next valve opening time can be limited. Furthermore, the shock at the time of contacting of the movable core 40 to the limiting portion 92 can be reduced by the urging force of the spring 73, and thereby it is possible to limit the secondary valve opening, which is caused by bouncing of the needle 30 at the valve seat 14. Furthermore, the movement of the movable core 40 toward the valve seat 14 is limited by the limiting portion 92, so that it is possible to limit excessive compression of the spring 73. Thus, it is possible to limit the secondary valve opening that is caused by recollision of the movable core 40 against the flange 33 due to urging of the movable core 40 in the valve opening direction by the restoring force of the spring 73, which has been excessively compressed.

In the present embodiment, the spring seat 91 and the limiting portion 92 are joined together through the tubular portion 93, which is shaped into the tubular form. Furthermore, the cylindrical space S2 is formed between the spring seat 91 and the tubular portion 93, which are located on the one side of the cylindrical space S2, and the needle main body 31, which is located on the other side of the cylindrical space S2.

Furthermore, (7) in the present embodiment, the gap forming member 60 is made of the non-magnetic material. Therefore, the gap forming member 60 does not receive the influence of the magnetic force generated by the coil 72. Thereby, it is possible to limit the movement of the gap forming member 60 relative to the needle 30 in the radial direction. Thus, uneven wearing between the first wall surface 601 of the gap forming member 60 and the outer wall of the flange 33 can be limited.

Furthermore, (8) in the present embodiment, the stationary core 50 includes the bush 52, which is shaped into the tubular form and has the inner wall opposed to the second wall surface 602. Thus, it is possible to limit sliding of the gap forming member 60 relative to the inner wall of the stationary core main body 51. The hardness of the bush 52 is set to be substantially the same as the hardness of the gap forming member 60. Therefore, even if the sliding occurs between the bush 52 and the gap forming member 60, it is possible to limit wearing of the bush 52 and the gap forming member 60.

Furthermore, (10) in the present embodiment, the needle main body 31 has the axial hole 313. The axial hole 313 extends in the axial direction of the axis Ax2 from the opposite end surface of the needle main body 31, which is opposite from the valve seat 14, and the axial hole 313 is communicated with the space outside of the needle main body 31.

The gap forming member 60 includes the hole 611, which connects between one end surface of the plate portion 61 and the other end surface of the plate portion 61 and is communicatable with the axial hole 313. Therefore, the fuel, which is located on the opposite side of the gap forming member 60 that is opposite from the valve seat 14 in the fuel passage 100, can flow to the valve seat 14 side of the movable core 40 through the hole 611 and the axial hole 313 of the needle 30. Furthermore, when the needle 30 is moved together with the gap forming member 60 to the opposite side, which is opposite from the valve seat 14, i.e., when the needle 30 is moved in the valve opening direction, the fuel, which is located on the opposite side of the gap forming member 60 that is opposite from the valve seat 14, flows into the axial hole 313 after the flow of the fuel is restricted through the hole 611. In this way, it is possible to limit an excessive increase in the moving speed of the needle 30 in the valve opening direction.

Furthermore, (11) in the present embodiment, the extending portion 62 is shaped into the tubular form. Therefore, the gap forming member 60 can be relatively easily formed.

Second Embodiment

Figure 6:
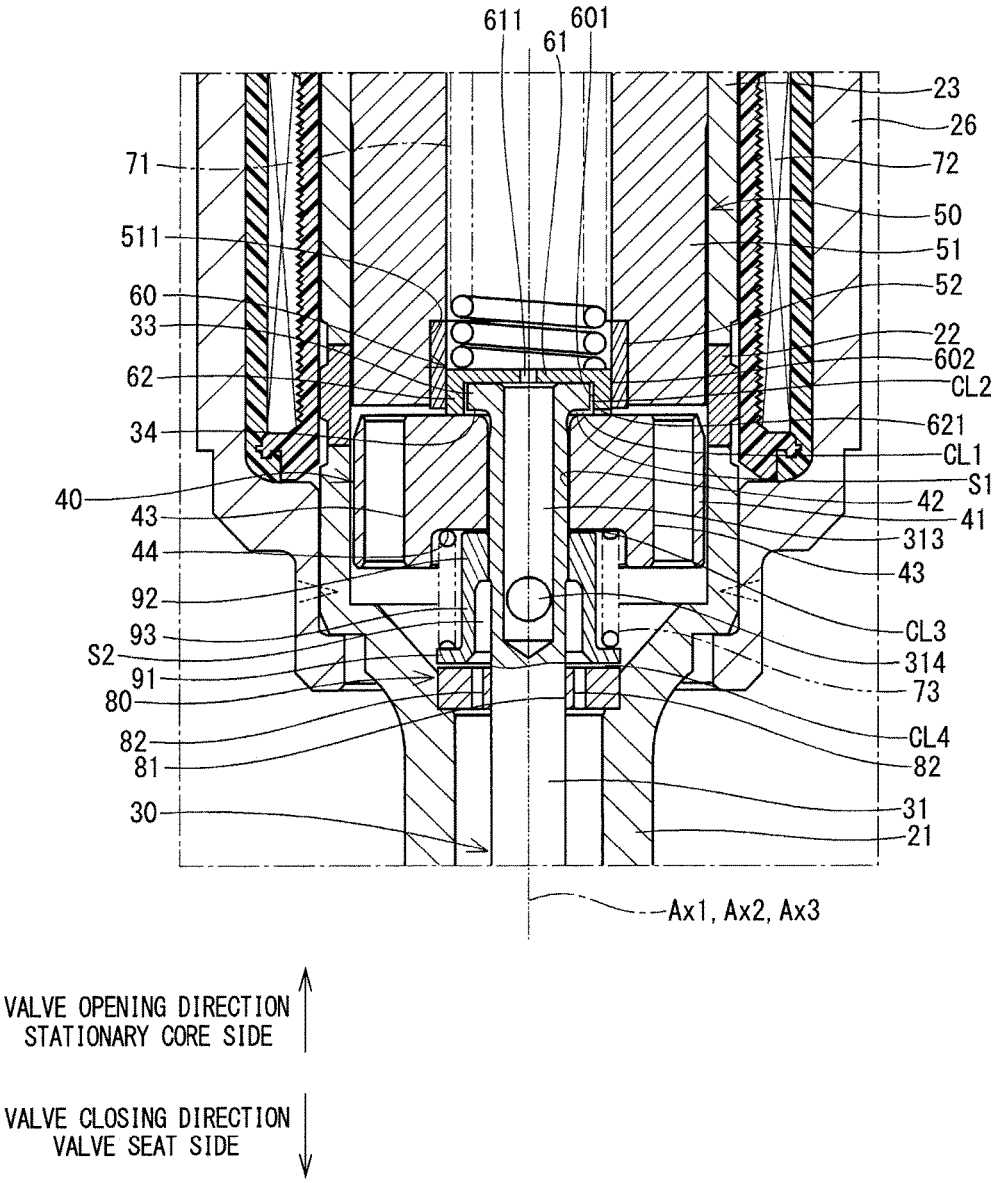
FIG. 6 is a cross-sectional view showing a movable core and its adjacent area at a fuel injection device according to a second embodiment of the present disclosure.

FIG. 6 shows a portion of the fuel injection device according to a second embodiment of the present disclosure. The second embodiment differs from the first embodiment with respect to the construction of the gap forming member 60.

In the second embodiment, the inner diameter of the extending portion 62 is set to be larger than the outer diameter of the flange 33. Therefore, the inner wall of the extending portion 62 of the gap forming member 60, i.e., the first wall surface 601 of the gap forming member 60, which is the wall surface opposed to the outer wall of the flange 33, forms the radial gap CL2, which is the gap in the radial direction, between the first wall surface 601 and the outer wall of the flange 33, so that the gap forming member 60 is movable relative to the needle 30. Therefore, the first wall surface 601 of the gap forming member 60 does not slide relative to the outer wall of the flange 33.

Furthermore, the outer diameter of the plate portion 61 and the extending portion 62 is set to be equal to or slightly smaller than the inner diameter of the stationary core 50. Therefore, the outer wall of the plate portion 61 and the extending portion 62, i.e., the second wall surface 602 of the gap forming member 60, which is the wall surface of the gap forming member 60 opposed to the inner wall of the bush 52 of the stationary core 50, is slidable relative to the inner wall of the bush 52.

The rest of the structure of the second embodiment, which is other than the above described structure, is the same as that of the first embodiment.

As discussed above, (2) in the present embodiment, the first wall surface 601 of the gap forming member 60, which is the wall surface opposed to the outer wall of the flange 33, forms the radial gap CL2, which is the gap in the radial direction, between the first wall surface 601 and the outer wall of the flange 33, and the second wall surface 602 of the gap forming member 60, which is the wall surface opposed to the inner wall of the stationary core 50, is slidable relative to the inner wall of the stationary core 50.

As discussed above, in the present embodiment, among the first wall surface 601 and the second wall surface 602 of the gap forming member 60, only the second wall surface 602 slides relative to the other member (the stationary core 50), and the first wall surface 601 does not slide relative to the other member (the flange 33). Therefore, it is possible to reduce the slide resistance acting on the gap forming member 60, and thereby it is possible to limit wearing or uneven wearing of the slide surface upon aging. In this way, it is possible to limit deterioration of the response of the needle 30, and the axial reciprocation of the needle 30 can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between the members, which make relative movement therebetween, and thereby it is possible to limit the malfunctioning.

Furthermore, according to the present embodiment, the gap forming member 60 is constructed such that only the second wall surface 602 slides relative to the stationary core 50. Therefore, management of the dimensions is eased, and it is possible to limit variations in the slide resistance among the individual products. Thus, it is possible to limit the variations in the injection amount of fuel even among the individual fuel injection devices.

In the present embodiment, the gap forming member 60 is constructed such that the second wall surface 602 slides relative to the inner wall of the stationary core 50. Therefore, the radial movement of the gap forming member 60 relative to the stationary core 50 is limited. Therefore, it is possible to limit the sliding of the first wall surface 601 of the gap forming member 60 relative to the outer wall of the flange 33.

Third Embodiment

Figure 7:
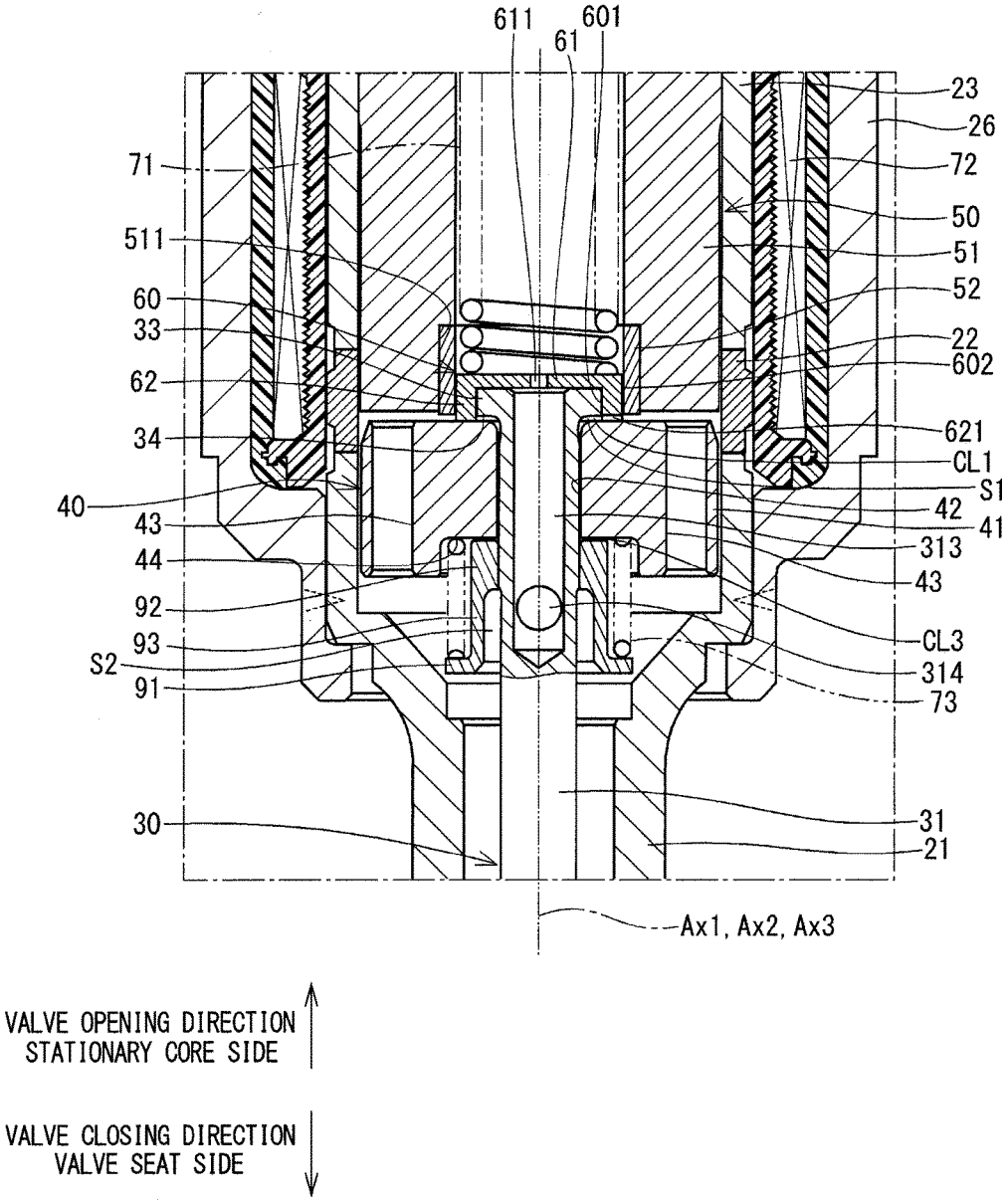
FIG. 7 is a cross-sectional view showing a movable core and its adjacent area in a fuel injection device according to a third embodiment of the present disclosure.

FIG. 7 shows a portion of the fuel injection device according to a third embodiment of the present disclosure. The third embodiment differs from the first embodiment with respect to the construction of the gap forming member 60.

In the third embodiment, the guide 80 is not provided unlike the first embodiment and the second embodiment.

An inner diameter of the extending portion 62 is set to be equal to or slightly larger than an outer diameter of the flange 33. Therefore, a first wall surface 601 of the gap forming member 60, which is a wall surface of an inner wall of the extending portion 62, i.e., a wall surface of the gap forming member 60 that is opposed to an outer wall of the flange 33, is slidable along the outer wall of the flange 33, and thereby the gap forming member 60 is movable relative to the needle 30.

Furthermore, the outer diameter of the plate portion 61 and the extending portion 62 is set to be equal to or slightly smaller than the inner diameter of the stationary core 50. Therefore, the outer wall of the plate portion 61 and the extending portion 62, i.e., the second wall surface 602 of the gap forming member 60, which is the wall surface of the gap forming member 60 opposed to the inner wall of the bush 52 of the stationary core 50, is slidable relative to the inner wall of the bush 52.

In the present embodiment, the valve seat 14 side end part of the needle 30 is reciprocatably supported by the inner wall of the nozzle tubular portion 11 of the nozzle 10, and a stationary core 50 side end part of the needle 30 is reciprocatably supported by the gap forming member 60 and the stationary core 50. As discussed above, the reciprocation of the needle 30 in the axial direction is guided at the two locations that are placed one after another in the axial direction of the axis Ax1 of the housing 20.

In the present embodiment, the first wall surface 601, the second wall surface 602, the outer wall of the flange 33, and the inner wall of the bush 52 of the stationary core 50 are processed through a slide resistance reducing process and a hardening process (e.g., Ni—P plating).

The rest of the structure of the third embodiment, which is other than the above described structure, is the same as that of the first embodiment.

As discussed above, (6) in the present embodiment, the first wall surface 601 of the gap forming member 60, which is opposed to the outer wall of the flange 33, is slidable relative to the outer wall of the flange 33, and the second wall surface 602 of the gap forming member 60, which is opposed to the inner wall of the stationary core 50, is slidable relative to the inner wall of the stationary core 50.

A slide resistance reducing process, which reduces a slide resistance relative to another member, is applied to the first wall surface 601, the second wall surface 602, the outer wall of the flange 33 and the inner wall of the stationary core 50.

As discussed above, in the present embodiment, although the gap forming member 60 has a double slide structure that is constructed such that the first wall surface 601 and the second wall surface 602 respectively slide relative to the other members (the flange 33, the stationary core 50), the slide resistance reducing process is applied to the first wall surface 601, the second wall surface 602, the outer wall of the flange 33 and the inner wall of the stationary core 50. Therefore, it is possible to reduce the slide resistance acting on the gap forming member 60, and thereby it is possible to limit wearing or uneven wearing of the slide surfaces upon aging. In this way, it is possible to limit deterioration of the response of the needle 30, and the axial reciprocation of the needle 30 can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between the members, which make relative movement therebetween, and thereby it is possible to limit the malfunctioning.

Fourth Embodiment

Figure 8:
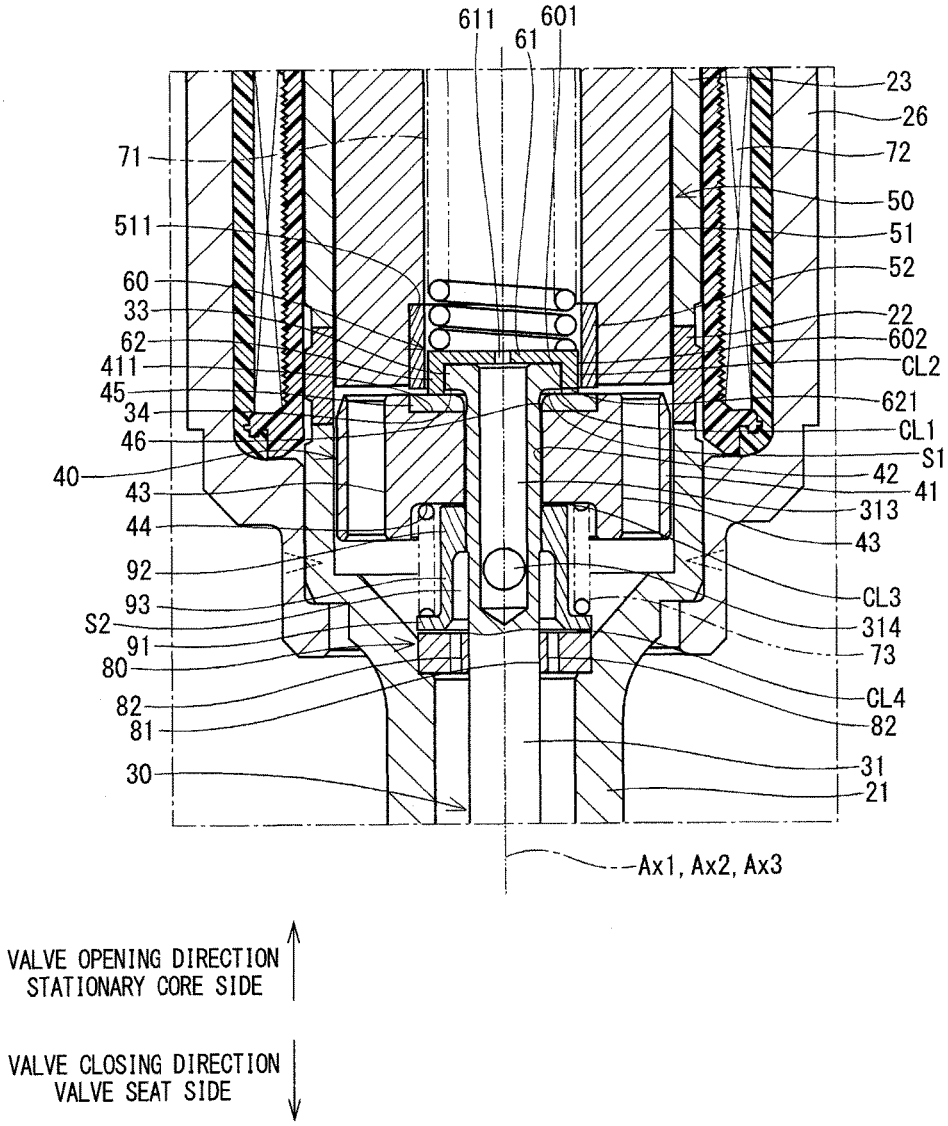
FIG. 8 is a cross-sectional view showing a movable core and its adjacent area at a fuel injection device according to a fourth embodiment of the present disclosure.

FIG. 8 shows a portion of the fuel injection device according to a fourth embodiment of the present disclosure. The fourth embodiment differs from the first embodiment with respect to the construction of the movable core 40.

In the fourth embodiment, the movable core 40 includes the movable core main body 41 and the contact portion 45.

The movable core main body 41 includes a recess 411, which is circular and is recessed from the stationary core 50 side end surface of the movable core main body 41 toward the valve seat 14.

The contact portion 45 is made of a material, such as martensitic stainless steel, which has a relatively high hardness. The hardness of the contact portion 45 is higher than the hardness of the movable core main body 41 and is generally the same as the hardness of the needle 30, the gap forming member 60 and the bush 52. The contact portion 45 is shaped into a generally circular plate form and is placed in the recess 411 of the movable core main body 41. The contact portion 45 has an axial hole 46 that extends through a center of the contact portion 45 in a plate thickness direction of the contact portion 45 and is connected to the axial hole 42 of the movable core main body 41. The needle main body 31 is received through the axial hole 46. An end surface of the contact portion 45, which is opposite from the valve seat 14, is contactable with the end surface of the flange 33, which is located on the valve seat 14 side, i.e., the contact surface 34, the valve seat 14 side end part of the extending portion 62 of the gap forming member 60, and the valve seat 14 side end part of the bush 52.

As discussed above, (9) in the present embodiment, the movable core 40 includes the movable core main body 41 and the contact portion 45 while the contact portion 45 has the hardness higher than that of the movable core main body 41 and is contactable with the flange 33, the extending portion 62 and the bush 52. Thereby, it is possible to limit contacting of the movable core main body 41 to the flange 33, the extending portion 62 and the bush 52. In this way, it is possible to limit the wearing of the movable core main body 41. Thus, it is possible to limit a change in a magnetic characteristic of the movable core 40, which would be otherwise caused by aging.

Fifth Embodiment

Figure 9:
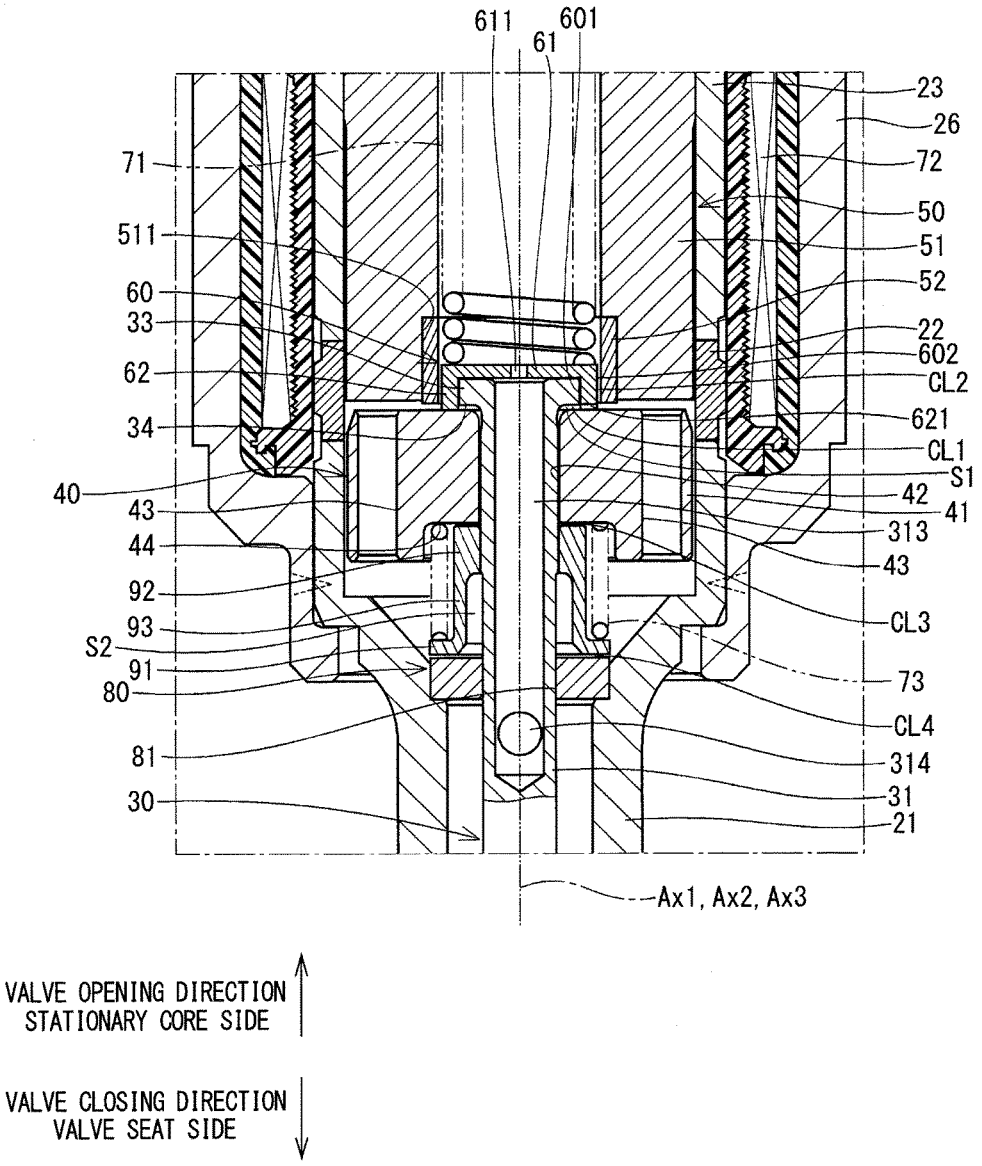
FIG. 9 is a cross-sectional view showing a movable core and its adjacent area at a fuel injection device according to a fifth embodiment of the present disclosure.

FIG. 9 shows a portion of the fuel injection device according to a fifth embodiment of the present disclosure. The fifth embodiment differs from the first embodiment with respect to the structure of the needle 30 and the structure of the guide 80.

In the fifth embodiment, the axial hole 313 of the needle 30 is formed to extend to the valve seat 14 side of the guide 80 in the state where the seal portion 32 contacts the valve seat 14. Furthermore, the radial holes 314 communicates between the axial hole 313 and the space located on the radially outer side of the needle main body 31 at a location that is on the valve seat 14 side of the guide 80. In this way, the fuel in a portion of the fuel passage 100 located on the side of the gap forming member 60, which is opposite from the valve seat 14, can flow to the valve seat 14 side of the guide 80 through the hole 611, the axial hole 313 and the radial holes 314.

Furthermore, in the present embodiment, the guide 80 does not include the flow passages 82 discussed in the first embodiment. In the present embodiment, the damper effect, which is exerted in the gap CL4 at the time of moving the needle 30 in the valve closing direction, can be further increased.

Other Embodiments

In the first and second embodiments, there are discussed the examples where the guide 80 is formed separately from the housing 20. Alternatively, in another embodiment of the present disclosure, for example, the guide 80 may be formed integrally with the first tubular portion 21 as one piece. In this case, it is possible to reduce the number of components in comparison to the first and second embodiments.

Furthermore, in another embodiment of the present disclosure, the spring seat 91 may be eliminated. In such a case, the end part of the stationary core side urging member (the spring 73), which is opposite from the movable core, may contact the inner wall of the guide 80 or the first tubular portion 21. Furthermore, in another embodiment of the present disclosure, the stationary core side urging member may be eliminated.

Furthermore, in another embodiment of the present disclosure, the limiting portion 92 may be eliminated.

Furthermore, in the third embodiment, there is described the example where the slide resistance reducing process ((e.g., Ni—P plating), which reduces the slide resistance relative to the other member, is applied to the first wall surface 601, the second wall surface 602, the outer wall of the flange 33, and the inner wall of the stationary core 50. Alternatively, in another embodiment of the present disclosure, the slide resistance reducing process may be applied to at least one of the first wall surface 601, the second wall surface 602, the outer wall of the flange 33, and the inner wall of the stationary core 50. Furthermore, (6) in another embodiment of the present disclosure, a hardening process (a slide resistance reducing process), such as a diamond-like carbon (DLC) coating, may be applied to at least one of the first wall surface 601, the second wall surface 602, the outer wall of the flange 33, and the inner wall of the stationary core 50. Therefore, it is possible to reduce the slide resistance acting on the gap forming member, and thereby it is possible to limit wearing or uneven wearing of the slide surface upon aging.

Furthermore, in another embodiment of the present disclosure, the gap forming member may be made of a magnetic member.

Furthermore, in another embodiment of the present disclosure, the stationary core main body 51 may not have the recess 511, and the stationary core 50 may not have the bush 52. In such a case, the second wall surface 602 of the gap forming member 60 may slide relative to the inner wall of the stationary core main body 51. In such a case, the end surface of the movable core 40, which is opposite from the valve seat 14, may be configured to contact the end surface of the stationary core main body 51, which is located on the valve seat 14 side.

Furthermore, in the fourth embodiment, there is described the example where the movable core 40 includes the contact portion 45 that has the hardness higher than the hardness of the movable core main body 41 and is contactable with the flange 33, the extending portion 62 and the bush 52. Alternatively, in another embodiment of the present disclosure, the contact portion 45 may contact only at least one of the flange 33, the extending portion 62 and the bush 52. Furthermore, in another embodiment of the present disclosure, the contact portion 45 may be formed integrally with the movable core main body 41 as a one-piece body instead of forming the contact portion 45 separately from the movable core main body 41. In such a case, a portion of this one-piece body, which corresponds to the movable core main body 41, may be processed to have the higher hardness that is higher than the hardness of another portion of the one-piece body, which corresponds to movable core main body 41.

Furthermore, in the above embodiments, there are described the examples where the inner diameter of the hole 611 of the gap forming member 60 is smaller than the inner diameter of the axial hole 313. Alternatively, in another embodiment of the present disclosure, the inner diameter of the hole 611 may be set to be equal to or larger than the inner diameter of the axial hole 313.

Furthermore, in the above embodiments, there are discussed the examples where the extending portion 62 of the gap forming member 60 is shaped into the tubular form. Alternatively, in another embodiment of the present disclosure, the shape of the extending portion 62 should not be limited to the tubular form. For example, the extending portion 62 may be in a form of a plurality of rods, each of which has the first wall surface 601 and the second wall surface 602.

Furthermore, in the above embodiments, there are described the examples where the nozzle 10 is formed separately from the housing 20. Alternatively, in another embodiment of the present disclosure, the nozzle 10 and the housing 20 may be formed integrally in one piece. Furthermore, the third tubular portion 23 and the stationary core main body 51 may be formed integrally in one piece.

Furthermore, in the above embodiments, there are discussed the examples where the flange 33 is formed at the other end of the needle main body 31. Alternatively, in another embodiment of the present disclosure, the flange 33 may be formed at a radially outer side of an adjacent part of the needle main body 31, which is adjacent to the other end of the needle main body 31. In such a case, the plate portion 61 of the gap forming member 60 does not contact the flange 33 and contacts only the needle main body 31.

Furthermore, in the above embodiments, there are discussed the examples where the through-holes 43 are formed in the movable core 40. Alternatively, in another embodiment of the present disclosure, the through-holes 43 may be eliminated from the movable core 40. In such case, although the moving speed of the movable core 40 at the initial stage of the energization is reduced, the excess moving speed of the movable core 40 can be limited. Thereby, this structure is advantageous in terms of limiting the overshooting of the need at the full lift time, limiting the bouncing of the movable core 40 at the full lift time, and limiting the bouncing at the valve closing time.

The application of the present disclosure should not be limited to a direct injection type gasoline engine. For example, the present disclosure may be applied to a port injection type gasoline engine or a diesel engine.

As discussed above, the present disclosure should not be limited to the above embodiments and may be embodied in various other forms without departing from the principle of the present disclosure.

The invention claimed is:

1. A fuel injection device comprising:

a nozzle that includes an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is formed on a radially outer side of the needle main body at another end of the needle main body or around the another end of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on the valve seat side of the flange;

a stationary core that is installed on an opposite side of the movable core, which is opposite from the valve seat, in the inside of the housing;

a gap forming member that has:

a plate portion that is placed on the opposite side of the needle, which is opposite from the valve seat, such that one end surface of the plate portion is contactable with the needle; and an extending portion that is formed to extend from the plate portion toward the valve seat, while an opposite end part of the extending portion, which is opposite from the plate portion, is contactable with the surface of the movable core located on the stationary core side, wherein the gap forming member is configured to form an axial gap, which is a gap defined in an axial direction between the flange and the movable core, when the plate portion and the extending portion are in contact with the needle and the movable core, respectively; and a valve seat side spring that is placed on the opposite side of the gap forming member, which is opposite from the valve seat, wherein the valve seat side spring is operable to urge the needle and the movable core toward the valve seat through the gap forming member;

a coil that is operable to attract the movable core toward the stationary core such that the movable core contacts the flange and drives the needle toward the opposite side, which is opposite from the valve seat, when the coil is energized; and a guide that is placed on the valve seat side of the movable core in the inside of the housing, and wherein an outer wall of the needle main body is slidable relative to the guide to guide reciprocation of the needle, wherein:

the gap forming member is formed such that a first wall surface of the gap forming member, which is a wall surface opposed to an outer wall of the flange, is slidable relative to the outer wall of the flange, and a second wall surface of the gap forming member, which is a wall surface opposed to an inner wall of the stationary core, forms a radial gap, which is a gap defined in a radial direction, between the second wall surface and the inner wall of the stationary core, and the radial gap continuously extends in a circumferential direction along the second wall surface all around the gap forming member to limit contact between the second wall surface and the inner wall of the stationary core.

2. The fuel injection device according to claim 1, wherein the guide is formed separately from the housing.

3. The fuel injection device according to claim 1, further comprising:

a spring seat that is shaped into a ring form and is placed at a location, which is on a radially outer side of the needle main body and is between the movable core and the guide; and a stationary core side spring that is placed between the movable core and the spring seat and has an urging force, which is smaller than an urging force of the valve seat side spring, wherein the stationary core side spring is operable to urge the movable core toward the stationary core.

4. The fuel injection device according to claim 1, further comprising a limiting portion that is placed at a location, which is on a radially outer side of the needle main body and is between the movable core and the guide, wherein the limiting portion is configured to limit movement of the movable core toward the valve seat through contacting of the limiting portion against a surface of the movable core located on the valve seat side.

5. The fuel injection device according to claim 1, wherein the gap forming member is made of a non-magnetic material.

6. The fuel injection device according to claim 1, wherein the stationary core includes a bush, which is shaped into a tubular form and has an inner wall that is opposed to the second wall surface.

7. The fuel injection device according to claim 6, wherein the bush is configured to limit movement of the movable core in a valve opening direction, which is a direction away from the valve seat, when the bush contacts the movable core.

8. The fuel injection device according to claim 1, wherein the movable core includes:

a movable core main body; and a contact portion that is placed on the opposite side of the movable core main body, which is opposite from the valve seat, wherein a hardness of the contact portion is higher than a hardness of the movable core main body, and the contact portion is contactable with at least one of the flange or the extending portion.

9. The fuel injection device according to claim 1, wherein:

the needle main body has an axial hole that extends in the axial direction from an end surface of the needle main body, which is opposite from the valve seat, while the axial hole is communicated with a space located at an outside of the needle main body; and the gap forming member has a hole that connects between one end surface and another end surface of the plate portion and is communicatable with the axial hole.

10. The fuel injection device according to claim 1, wherein the extending portion is shaped into a tubular form.

11. A fuel injection device comprising:

a nozzle that includes an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is formed on a radially outer side of the needle main body at another end of the needle main body or around the another end of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on the valve seat side;

a stationary core that is installed on an opposite side of the movable core, which is opposite from the valve seat, in the inside of the housing;

a gap forming member that has:

a plate portion that is placed on the opposite side of the needle, which is opposite from the valve seat, such that one end surface of the plate portion is contactable with the needle; and an extending portion that is formed to extend from the plate portion toward the valve seat, while an opposite end part of the extending portion, which is opposite from the plate portion, is contactable with the surface of the movable core located on the stationary core side, wherein the gap forming member is configured to form an axial gap, which is a gap defined in an axial direction between the flange and the movable core, when the plate portion and the extending portion are in contact with the needle and the movable core, respectively; and a valve seat side spring that is placed on the opposite side of the gap forming member, which is opposite from the valve seat, wherein the valve seat side spring is operable to urge the needle and the movable core toward the valve seat through the gap forming member;

a coil that is operable to attract the movable core toward the stationary core side such that the movable core contacts the flange and drives the needle toward the opposite side, which is opposite from the valve seat, when the coil is energized; and a guide that is placed on the valve seat side of the movable core in the inside of the housing and wherein an outer wall of the needle main body is slidable relative to the guide to guide reciprocation of the needle, wherein:

the gap forming member is formed such that a first wall surface of the gap forming member, which is a wall surface opposed to an outer wall of the flange, forms a radial gap, which is a gap defined in a radial direction, between the first wall surface and the outer wall of the flange, and a second wall surface of the gap forming member, which is a wall surface opposed to an inner wall of the stationary core, is slidable relative to the inner wall of the stationary core.

12. The fuel injection device according to claim 11, wherein the guide is formed separately from the housing.

13. The fuel injection device according to claim 11, further comprising:

a spring seat that is shaped into a ring form and is placed at a location, which is on a radially outer side of the needle main body and is between the movable core and the guide; and a stationary core side spring that is placed between the movable core and the spring seat and has an urging force, which is smaller than an urging force of the valve seat side spring, wherein the stationary core side spring is operable to urge the movable core toward the stationary core.

14. The fuel injection device according to claim 11, further comprising a limiting portion that is placed at a location, which is on a radially outer side of the needle main body and is between the movable core and the guide, wherein the limiting portion is configured to limit movement of the movable core toward the valve seat through contacting of the limiting portion against a surface of the movable core located on the valve seat side.

15. The fuel injection device according to claim 11, wherein the gap forming member is made of a non-magnetic material.

16. The fuel injection device according to claim 11, wherein the stationary core includes a bush, which is shaped into a tubular form and has an inner wall that is opposed to the second wall surface.

17. The fuel injection device according to claim 16, wherein the bush is configured to limit movement of the movable core in a valve opening direction, which is a direction away from the valve seat, when the bush contacts the movable core.

18. The fuel injection device according to claim 11, wherein the movable core includes:

a movable core main body; and a contact portion that is placed on the opposite side of the movable core main body, which is opposite from the valve seat, wherein a hardness of the contact portion is higher than a hardness of the movable core main body, and the contact portion is contactable with at least one of the flange or the extending portion.

19. The fuel injection device according to claim 11, wherein:

the needle main body has an axial hole that extends in the axial direction from an end surface of the needle main body, which is opposite from the valve seat, while the axial hole is communicated with a space located at an outside of the needle main body; and the gap forming member has a hole that connects between one end surface and another end surface of the plate portion and is communicatable with the axial hole.

20. The fuel injection device according to claim 11, wherein the extending portion is shaped into a tubular form.

21. A fuel injection device comprising:

a nozzle that includes an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is formed on a radially outer side of the needle main body at another end of the needle main body or around the another end of the needle main body, wherein the needle is installed such that the needle is reciprocatable in the fuel passage, and when the seal portion is lifted away from or is seated against the valve seat, the needle opens or closes the injection hole;

a movable core that is installed such that the movable core is movable relative to the needle main body and has a surface, which is opposite from the valve seat and is contactable with a surface of the flange located on the valve seat side;

a stationary core that is installed on an opposite side of the movable core, which is opposite from the valve seat, in the inside of the housing;

a gap forming member that has:

a plate portion that is placed on the opposite side of the needle, which is opposite from the valve seat, such that one end surface of the plate portion is contactable with the needle; and an extending portion that is formed to extend from the plate portion toward the valve seat, while an opposite end part of the extending portion, which is opposite from the plate portion, is contactable with the surface of the movable core located on the stationary core side, wherein the gap forming member is configured to form an axial gap, which is a gap defined in an axial direction between the flange and the movable core, when the plate portion and the extending portion are in contact with the needle and the movable core, respectively; and a valve seat side spring that is placed on the opposite side of the gap forming member, which is opposite from the valve seat, wherein the valve seat side spring is operable to urge the needle and the movable core toward the valve seat side through the gap forming member; and a coil that is operable to attract the movable core toward the stationary core such that the movable core contacts the flange and drives the needle toward the opposite side, which is opposite from the valve seat, when the coil is energized, wherein:

the gap forming member is formed such that a first wall surface of the gap forming member, which is a wall surface opposed to an outer wall of the flange, is slidable relative to the outer wall of the flange, and a second wall surface of the gap forming member, which is a wall surface opposed to an inner wall of the stationary core, is slidable relative to the inner wall of the stationary core; and all of the first wall surface, the second wall surface, the outer wall of the flange and the inner wall of the stationary core are surface processed through a slide resistance reducing process, which reduces a slide resistance relative to another member, or a hardening process.

22. The fuel injection device according claim 21, wherein the gap forming member is made of a non-magnetic material.

23. The fuel injection device according to claim 21, wherein the stationary core includes a bush, which is shaped into a tubular form and has an inner wall that is opposed to the second wall surface.

24. The fuel injection device according to claim 23, wherein the bush is configured to limit movement of the movable core in a valve opening direction, which is a direction away from the valve seat, when the bush contacts the movable core.

25. The fuel injection device according to claim 21, wherein the movable core includes:

a movable core main body; and a contact portion that is placed on the opposite side of the movable core main body, which is opposite from the valve seat, wherein a hardness of the contact portion is higher than a hardness of the movable core main body, and the contact portion is contactable with at least one of the flange or the extending portion.

26. The fuel injection device according to claim 21, wherein:

the needle main body has an axial hole that extends in the axial direction from an end surface of the needle main body, which is opposite from the valve seat, while the axial hole is communicated with a space located at an outside of the needle main body; and the gap forming member has a hole that connects between one end surface and another end surface of the plate portion and is communicatable with the axial hole.

27. The fuel injection device according to claim 21, wherein the extending portion is shaped into a tubular form.

* * * * *